US007419215B2

(12) United States Patent
Wilkerson et al.

(10) Patent No.: US 7,419,215 B2
(45) Date of Patent: Sep. 2, 2008

(54) CHAIR HAVING A SEAT WITH ADJUSTABLE FRONT EDGE

(75) Inventors: Larry Wilkerson, Comstock Park, MI (US); Gardner Klassen, Ada, MI (US); Mark Tomandl, Allendale, MI (US)

(73) Assignee: Haworth, Inc., Holland, MI (US)

( * ) Notice: Subject to any disclaimer, the term of this patent is extended or adjusted under 35 U.S.C. 154(b) by 206 days.

(21) Appl. No.: 11/124,973

(22) Filed: May 9, 2005

(65) Prior Publication Data

US 2005/0258678 A1 Nov. 24, 2005

Related U.S. Application Data

(63) Continuation of application No. 10/314,767, filed on Dec. 9, 2002, now Pat. No. 6,890,030, which is a continuation of application No. 10/209,950, filed on Jul. 31, 2002, now abandoned.

(60) Provisional application No. 60/309,129, filed on Jul. 31, 2001.

(51) Int. Cl.
*A47C 7/14* (2006.01)

(52) U.S. Cl. ..... 297/284.11; 297/284.2

(58) Field of Classification Search ..... 297/284.11, 297/284.2

See application file for complete search history.

(56) References Cited

U.S. PATENT DOCUMENTS

| | | | | |
|---|---|---|---|---|
| 3,883,173 | A * | 5/1975 | Shephard et al. | 297/312 |
| 4,153,294 | A * | 5/1979 | Meiller et al. | 297/284.11 |
| 4,652,049 | A * | 3/1987 | Maruyama et al. | 297/284.11 |
| 5,716,099 | A * | 2/1998 | McDiarmid | 297/302.1 |
| 6,106,063 | A * | 8/2000 | Dauphin | 297/284.11 |
| 6,375,261 | B1 * | 4/2002 | Link | 297/284.11 |
| 6,394,548 | B1 * | 5/2002 | Battey et al. | 297/342 |
| 6,419,317 | B1 * | 7/2002 | Westrich et al. | 297/284.11 |
| 6,422,650 | B1 * | 7/2002 | Chien-Shen | 297/312 |
| 6,454,353 | B1 * | 9/2002 | Knaus | 297/284.11 |
| 6,499,802 | B2 * | 12/2002 | Drira | 297/284.11 |
| 6,601,918 | B2 * | 8/2003 | Mattsson | 297/284.11 |

* cited by examiner

*Primary Examiner*—Sarah B McPartlin
(74) *Attorney, Agent, or Firm*—Flynn, Thiel, Boutell & Tanis, P.C.

(57) ABSTRACT

A chair is provided having a seat with a resiliently deflectable shell defining a front portion thereof. The front shell is deflectable downwardly in response to the user. An adjustment mechanism is provided which controls the deflected position of the front shell section to provide for controlled deflection of the seat which adjusts the effected length of the seat while also providing for user responsive deflection of the seat.

22 Claims, 18 Drawing Sheets

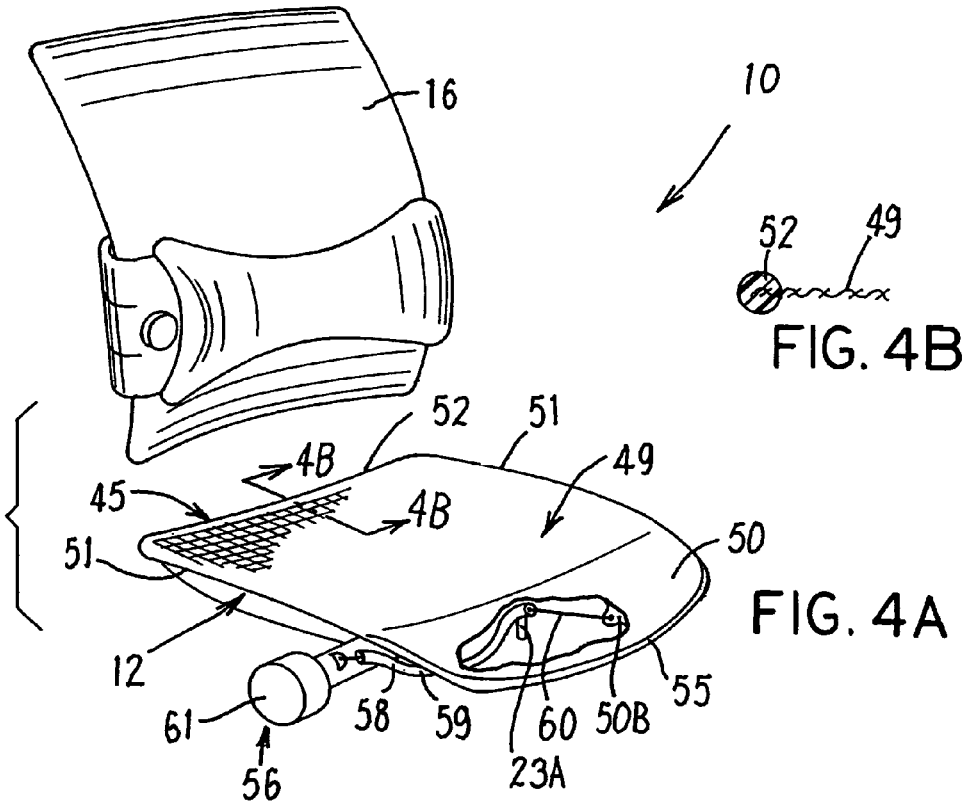
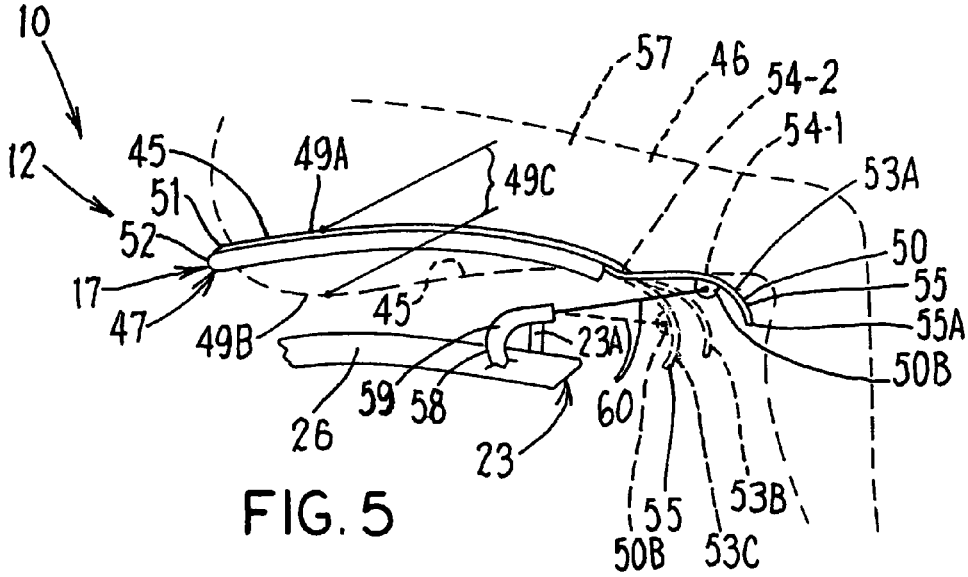
FIG. 5

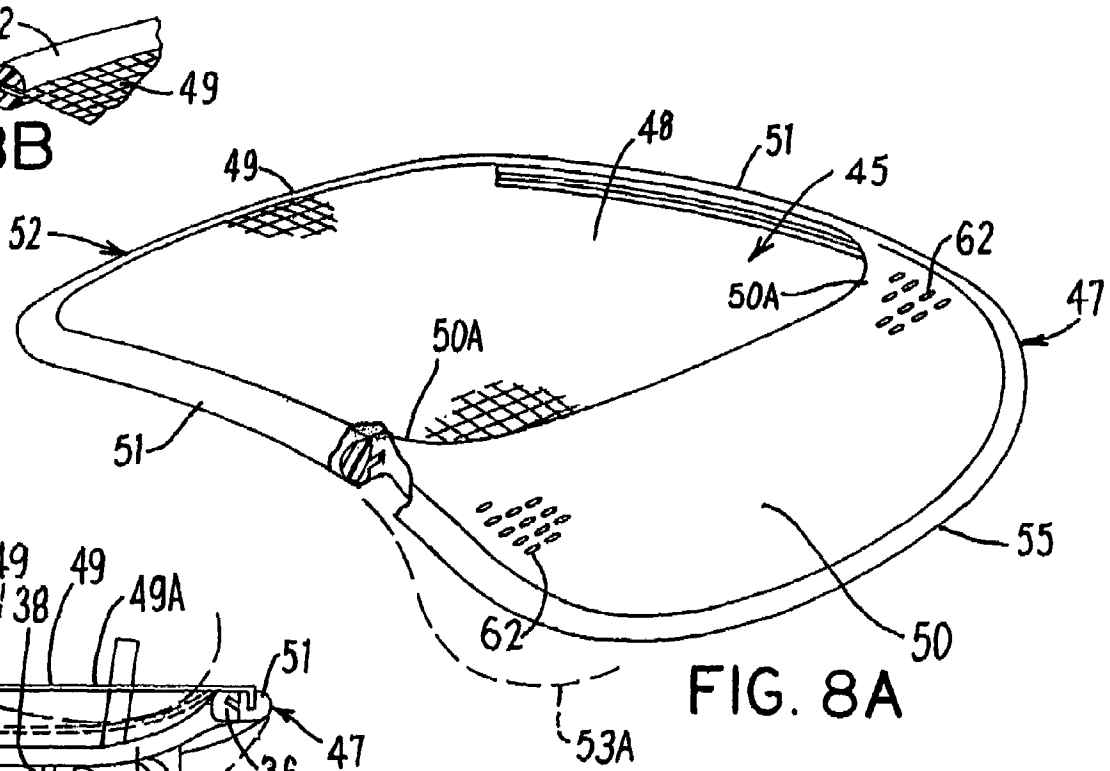
FIG. 8A
FIG. 8B
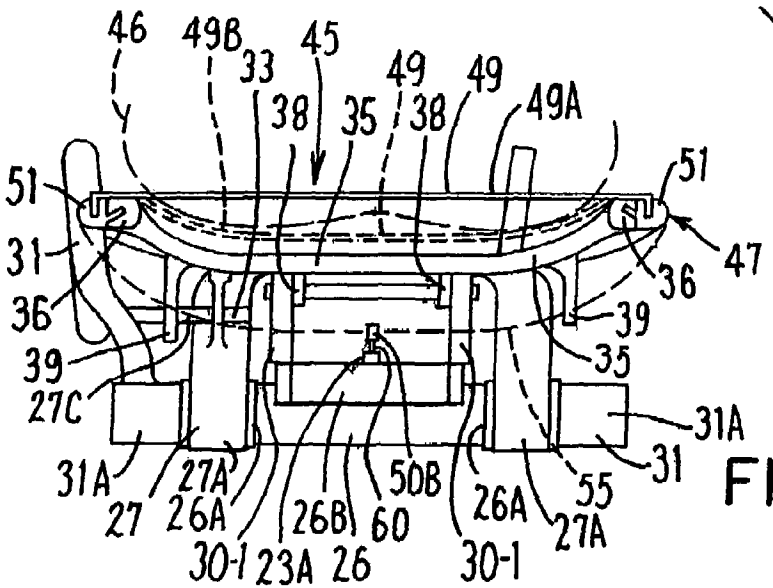
FIG. 9

CHAIR HAVING A SEAT WITH ADJUSTABLE FRONT EDGE

CROSS REFERENCE TO RELATED APPLICATION

This application is a Continuation of U.S. Ser. No. 10/314,767, filed Dec. 9, 2002 now U.S. Pat. No. 6,890,030, which is a Continuation of U.S. Ser. No. 10/209,950, filed Jul. 31, 2002 now abandoned which claims the benefit of U.S. Provisional Application No. 60/309,129, filed Jul. 31, 2001.

FIELD OF THE INVENTION

The invention relates to an improved office chair having an adjustable seat assembly, and more particularly, to a seat having an adjustable front edge.

BACKGROUND OF THE INVENTION

Office chairs include a seat-back arrangement having a horizontally enlarged seat and a back projecting upwardly from a rear edge of the seat. The seat has a front edge thereof which defines the forwardmost point of contact between the upward facing seat surface and the thighs of a chair occupant or user. Various chairs have been designed which allow for adjustment of the contact points between the chair seat and the occupant's thighs.

The invention relates to an improved chair seat arrangement which allows adjustment of the contact point. In the inventive seat arrangement, the seat includes a front portion thereof which is adapted to support the thighs of the user and also is deflectable downwardly in response to the weight of the occupant and the occupant's movements. The seat is formed of a resilient material which is normally biased to an undeflected position.

To adjust the contact point between the front seat section and the occupant's thighs, an adjustment mechanism is provided so that the front seat portion may be pulled downwardly or pushed upwardly depending upon the seat construction, which adjusts the forwardmost contact point between the front seat section and the occupant's thighs and thereby adjusts the effective length of the seat. The adjustment mechanism preferably provides an adjustment force acting opposite to the resilient restoring force of the seat while the seat section remains essentially unrestrained in the downward direction. Thus, when the adjustment mechanism modifies the deflection of the front seat section to an adjusted position, the front seat section is still able to move downwardly away from the adjusted position in response to the weight and movements of the occupant, or upon removal of the occupant's influences, to restore itself to the adjusted position defined by the adjustment mechanism.

In one embodiment, the adjustment mechanism comprises a cable which is connected to the front seat section wherein pulling on the cable pulls the front seat section downwardly, but the flexibility of the cable still allows for additional downward deflection away from the adjusted position. In another embodiment, the adjustment mechanism may comprise a resilient lever which pushes the seat upwardly but is deflectable downwardly.

Other objects and purposes of the invention, and variations thereof, will be apparent upon reading the following specification and inspecting the accompanying drawings.

BRIEF DESCRIPTION OF THE DRAWINGS

FIG. 4 is perspective view of a modified embodiment of the chair.

FIG. 5 is a side view illustrating a first adjustment mechanism for the front seat edge.

FIG. 8 is an enlarged perspective view of the suspension seat assembly.

FIG. 9 is a front view of the chair.

Figure 1:
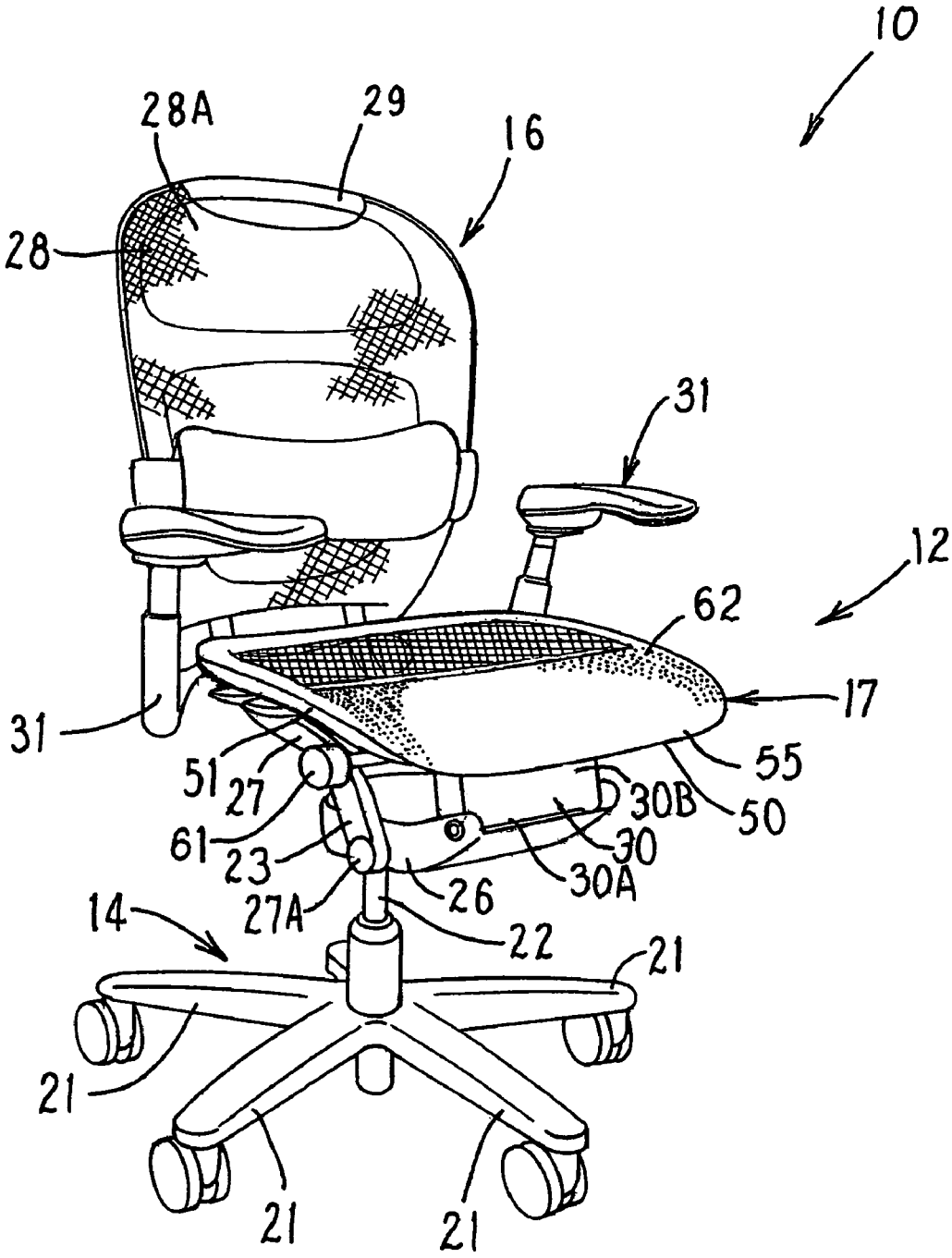
FIG. 1 is a perspective view of a chair having an improved suspension seat assembly with a deflectable front edge.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Referring to FIG. 1, a chair 10 is illustrated having a seat unit 12 supported on a pedestal or base 14 and a back unit 16 pivotally connected to the pedestal 14. The chair 10 includes an improved suspension seat assembly 17 and suspension back assembly 28.

Generally, the office chair 10 includes the base 14 having legs 21 radiating outwardly from a lower end of a vertical post 22. The outer ends of the legs 21 include conventional casters which support the office chair 10 on a floor or other similar surface.

The upper end of the pedestal 22 rigidly supports the seat unit 12 thereon. In particular, the seat unit 12 includes a structural seat frame 23 and the horizontally enlarged suspension seat assembly 17 which seat assembly 17 overlies and is supported on the seat frame 23.

Figure 3:
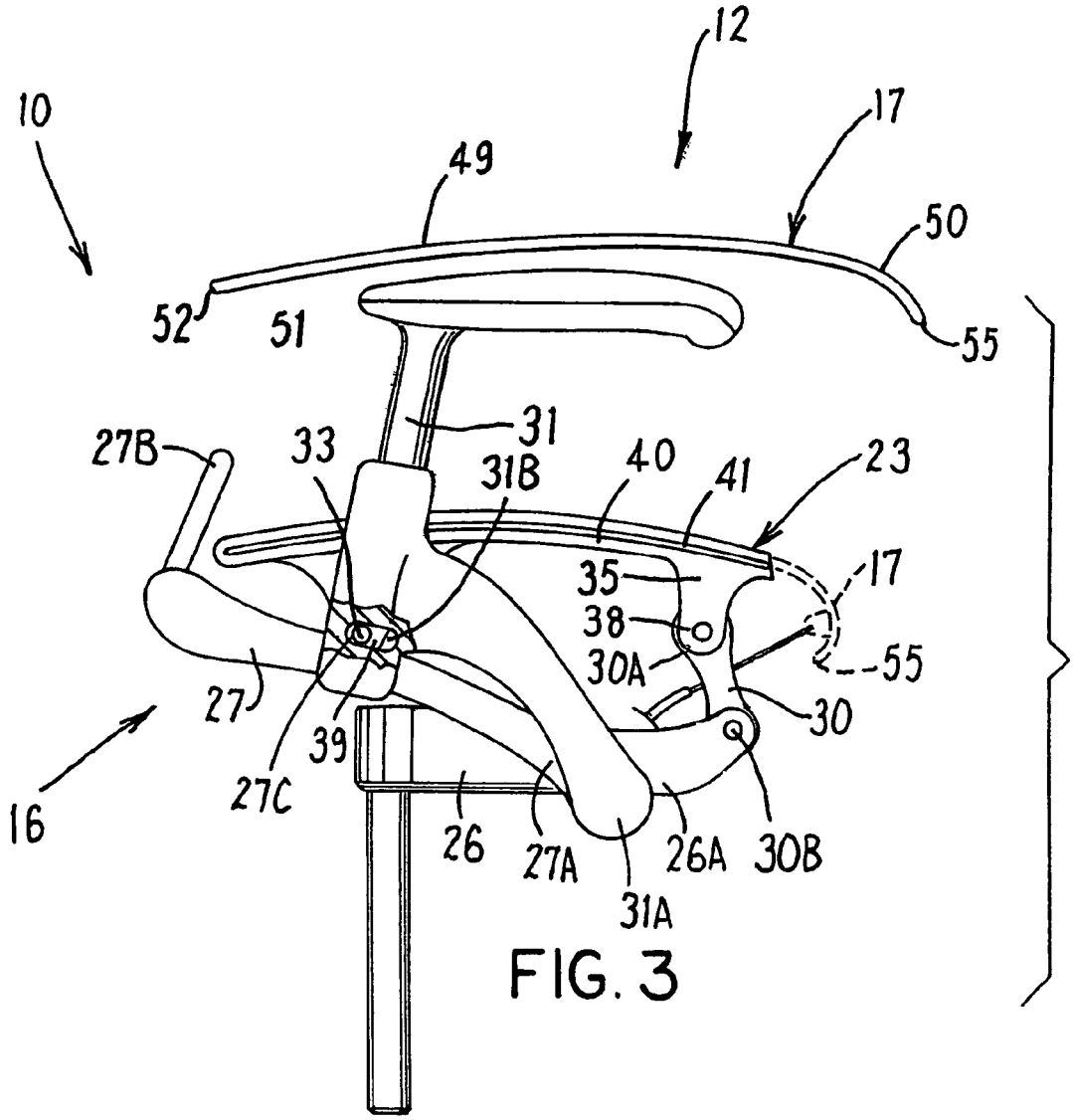
FIG. 3 is an exploded side view of a structural frame and the suspension seat assembly therefor.

Referring to FIG. 3, the base 14 generally includes a rigid arm or housing 26 which is rigidly connected to the pedestal 22 and is cantilevered outwardly therefrom, and an L-shaped upright 27 which uses a pair of spaced apart lower portions pivotally connected to the arm 26 at opposite sides of intermediate portions 26A thereof. The upper end 27B of the upright 27 supports the back unit 16 thereon. The back unit 16 includes a vertically enlarged suspension back assembly 28 that has a suspension fabric 28A which supports the body of the chair occupant and a back frame 29 by which the back assembly 28 is connected to the seat unit 12.

The base 20 further includes a front link 30 which is pivotally connected at a lower end 30A to the front arm 26 forwardly of the upright 27. The seat frame 23 is pivotally connected to the upper end 30B of the front link 30 and also to the lower portions 27A of the upright 27 at connecting points 27C to thereby define a four-bar linkage which governs simultaneous tilting of the seat unit 12 and the back unit 16. The four-bar linkage includes a spring arrangement 32 (FIG. 12) to resist tilting wherein the linkage and spring arrangement effectively define a tilt control unit.

A pair of support arms 31 also are pivotally connected to opposite sides of the arm 26 at the intermediate arm portions 26A by lower ends 31A. Further, the support arms 31 have a slot 31B therein which receives a pivot pin 33 slidably received therein. As a result, rearward tilting of the back unit 16 causes a corresponding downward tilting of the seat unit 12 about the front link 30 and a corresponding pivoting movement of the arms 31.

Referring to the seat frame 23 (FIGS. 3, 10 and 11), the seat frame 23 includes a pair of cross bars 35 which extend sidewardly or laterally and have opposite ends that curve upwardly and support side frame rails 36 thereon. The side frame rails 36 are laterally spaced apart and extend generally forwardly to define opposite side edges of the seat unit 12.

Figure 10:
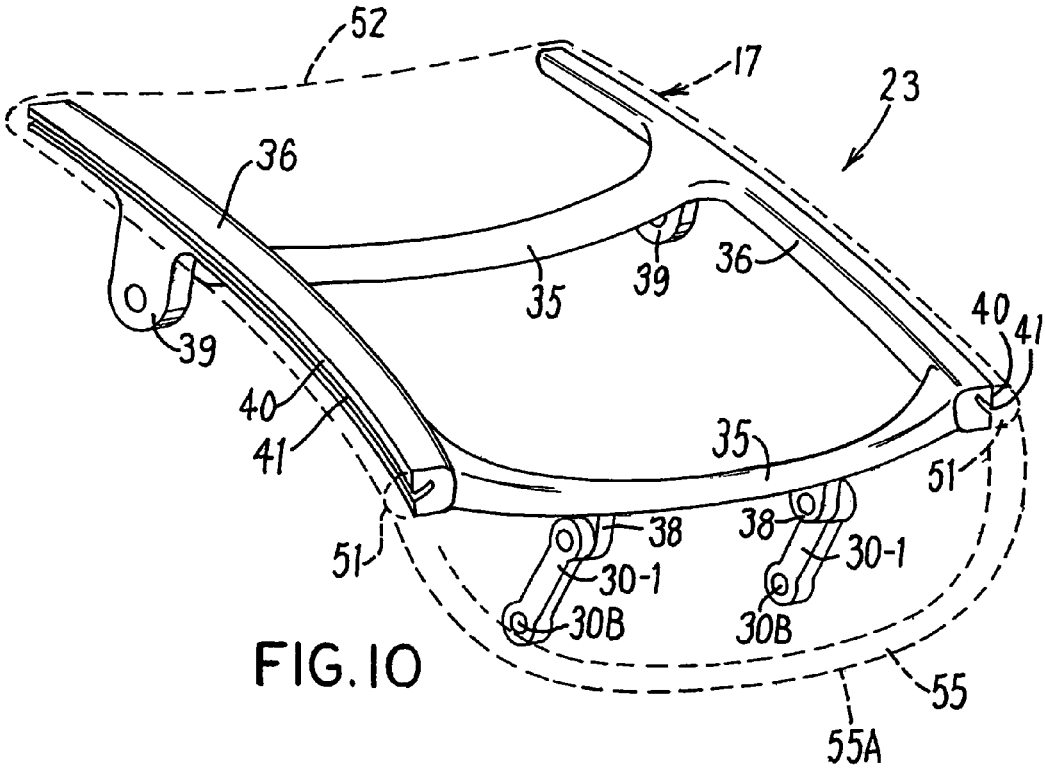
FIG. 10 is a top front perspective view of a seat frame.
Figure 11:
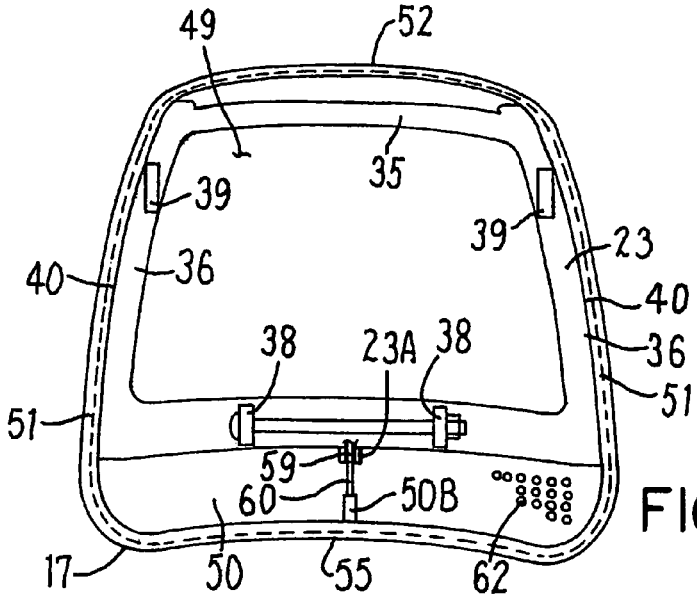
FIG. 11 is a bottom view of the seat frame.

The front cross bar 35 includes a pair of pivot flanges or ears 38 which project downwardly therefrom and are pivotally connected to the upper end 30A of the front link 30. As seen in FIGS. 9 and 10, the plate-like front link 30 of FIG. 1-3 could also be formed as two separate links 30-1. Near the opposite ends of the rear cross bar 35, a pair of additional pivot flanges 39 are provided which are pivotally connected to the upright 27. Accordingly, the seat frame 23 defines a generally horizontal link of the four-bar linkage.

Each side rail 36 includes an outer face 40 which has a groove 41 formed therein. The groove 41 (FIG. 6B) extends inwardly into the material of the side rail 36 and in the illustrated embodiment, angles generally upwardly. The grooves 41 of the side rails 36 are provided to support the opposite side edges of the suspension seat assembly 17 as described herein.

Preferably, the seat frame 36 is formed of a rigid, molded material such as PET.

Referring to the suspension seat assembly 17 (FIGS. 1, 2, 8 and 9), this assembly 17 defines an upward facing support surface 45 on which the seat of an occupant 46 is supported as seen in FIGS. 5 and 9. The seat assembly 17 includes a molded shell 47 having a generally peripheral shape which defines a central opening 48, and a suspension fabric 49 which is connected about its periphery to the shell 47. The fabric 49 is an air-permeable and elastomeric membrane or mesh which provides improved comfort for the occupant 46.

More particularly, the shell 47 comprises an enlarged front panel 50 which defines a front edge or lip 55 of the shell 47, a pair of laterally spaced apart side supports or edgings 51 which extend rearwardly from the front panel 50 and a rear bead 52 which extends laterally between and is connected to the rear ends of the edgings 51. These shell sections preferably are molded together wherein the peripheral edges of the suspension fabric 49 are encapsulated within the shell material 47 during the molding process. Further, it is preferable to mold the front panel 50 integral with the seat frame 23, lay the fabric 49 over the upper frame surfaces and then overmold a perimetral trim piece about the edges of the frame including the front lip 55 to secure the fabric 49 thereon as discussed in further detail herein.

The mesh 49 is normally in an undeflected condition as indicated by reference line 49A in FIGS. 5 and 9. When the occupant 46 sits thereon, the mesh deflects an amount defined by the weight of the user as indicated by the deflected position 49B. The difference between the positions 49A and 49B is the total deflection of mesh 49C.

Figure 6A:
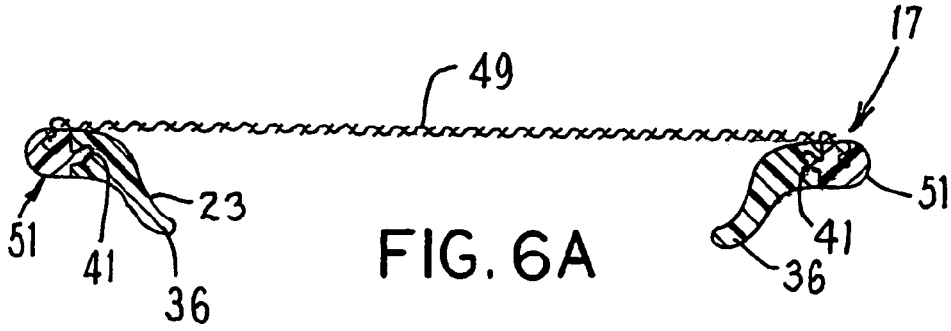
FIG. 6A is a front view of a suspension seat assembly.
Figure 6B:
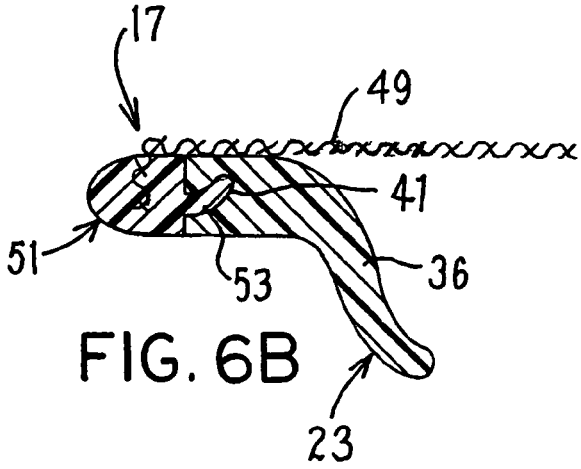
FIG. 6B is an enlarged edge detail of the seat assembly.
Figure 7:
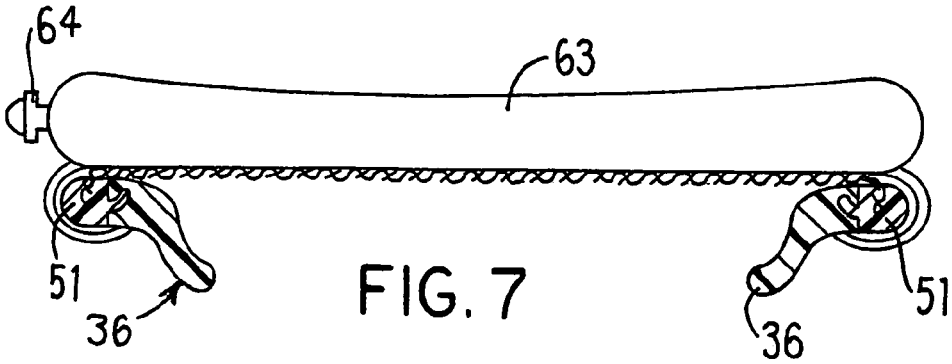
FIG. 7 is a front view of a modified version of the seat assembly.

Referring to the illustrated embodiment of FIG. 6B, the edgings 51 thereof are adapted to be deformed outwardly and then snapped onto the side frame rails 36 of the structural frame 23. In particular, the edgings 51 have an inwardly projecting tongue or rib 53 (FIG. 6B) which is adapted to be fitted into the corresponding groove 41 of the side rail 36. As such, a tongue and groove connection is provided between each shell edging 51 and the frame side rail 36 connected thereto. The edgings 51 thereby define bull-nosed protective edges. When the edgings 51 are connected on the frame rails 36, the edgings 51 preferably are formed of a material which is more deformable than the frame rail 36 so that each edging 51 serves as a relatively soft, side bumper which protects against injury of the occupant when the occupant bumps into the side of the chair.

Therefore, the suspension seat assembly 17 is rigidly connected to but is only supported along its opposite side edges on the frame rails 36. This is accomplished by spreading the edgings 51 laterally apart from each other and snapping the edgings 51 onto the frame rail 36. Notably, however, the flexible front panel 50 and the rear bead 52 are not supported vertically on any underlying frame work 23 but instead extend laterally between and in effect are suspended from the side frame rails 36. Since the structural frame 23 is rigid, the edgings 51 have little if any inward deflection toward each other when the suspension fabric 49 is placed under load by the occupant as seen in FIGS. 5 and 9. Further, the front panel 50 has a relatively large width in the front to rear direction and thus has little if any deflection rearwardly when the suspension fabric 49 is loaded.

However, the rear bead 52 has a relatively small cross-sectional area, for example, as seen in FIG. 8 and is deflectable not only downwardly but also forwardly under load. The rear bead 52 still has sufficient rigidity to return the suspension fabric 49 to a normal undeflected condition (FIG. 8) and also maintain the fabric 49 taut in this condition. However, the rear bead 52 also deflects to permit the suspension fabric 49 to conform to the shape of the seat of the occupant 46 as generally illustrated in FIGS. 5 and 9.

As to the front panel 50, the center section of the front panel 50 is transversely deflectable downwardly near the juncture between the fabric 49 and the front panel 50. In other words, the transverse deflection of the front panel 50 progressively increases or bows laterally towards the center.

Also, the front panel 50 is connected to and extends forwardly from the side rails 36 in cantilevered relation therewith. The front panel 50 is deflectable or generally pivotable to permit downward deflection of the front lip 55 as indicated by dotted reference line 53A in FIG. 8.

To avoid formation of a sharp hinge line which extends laterally between the front ends of the side rails 36, the front panel 50 preferably has curved corners 50A. The added material of the corners 50A tends to cause bending of the front panel 50 about a larger radius of curvature and avoids a sharp hinge line.

Preferably, the front panel 50 is formed with ribs either on the bottom or top surface thereof. The ribs extend sidewardly across the bottom and are formed in parallel, rearwardly spaced relation relative to each other. Preferably, the ribs decrease in thickness in a direction moving from the outer side edge to the center of the front panel 50. This provides for a progressively decreasing thickness of the front panel 50 towards the middle thereof and serves to facilitate and control deflection of the front panel 50. Alternatively, the ribs may be formed as grooves which have an increasing depth to provide for variable thickness in the front edge section.

More particularly, the front panel 50 is able to bow under the weight of the user as viewed in the transverse or side-to-side direction to conform to the occupant's shape. Also, the front lip thereof may. deflect or pivot downwardly to the deflected position 53A illustrated in phantom outline in FIG. 8 in response to user movements.

FIGS. 1 and 5 illustrate the front panel 50 in an undeflected position wherein the front panel 50 extends generally horizontally to support the thigh 57 of the occupant 46. Since the front panel 50 is resilient and generally cantilevered relative to the frame 23, the front panel 50 is thereby resiliently deflectable downwardly. The resilience of the front panel 50, however, normally biases the front panel 50 upwardly. When the front panel 50 is completely unrestrained, it maintains the generally horizontal position indicated by reference arrow 53A. Under the influence of the occupant 46 such as the weight of the occupant or movements of the occupant, the front panel 50 may deflect resiliently downwardly, for example, to the position diagrammatically illustrated by reference line 53B.

Under the normal flexing of the front panel 50, the occupant's thighs 57 remain in contact with the front panel 50 substantially along the entire length thereof, except that there is curvature associated with the front panel 50 such that a forwardmost point of contact 54-1 (FIG. 5) between the thighs 57 and the front panel 50 is spaced at least a short distance from the terminal edge 55A of the panel lip 55. The separation point between the thighs 57 and the front panel 50 is referenced herein as the contact point between the thighs 57 and front panel 50 with it being understood that the thighs 57 extend rearwardly from this contact point and remain in continuous contact back to the rear edge of the seat. The overall distance between the rear seat edge and the contact point defines the overall or effective length of the seat.

Additionally, while the front panel 50 may deflect downwardly in response to the weight of the occupant, a first embodiment of an adjustment mechanism 56 (FIG. 4) also is provided to pull the front lip 55 of the front panel 50 downwardly and thereby adjust the contact location 54-1, 54-2 (FIG. 5) of the front panel 50 with the thigh 57 of the occupant.

As seen in FIG. 5, the adjustment mechanism 56 includes a pull cable 58 which has a sheath 59 that is fixed to the chair frame 23 and an inner cable 60 which extends forwardly and is connected to a flange 50B centrally located and formed integrally on the underside of the front panel 50.

Figure 2:
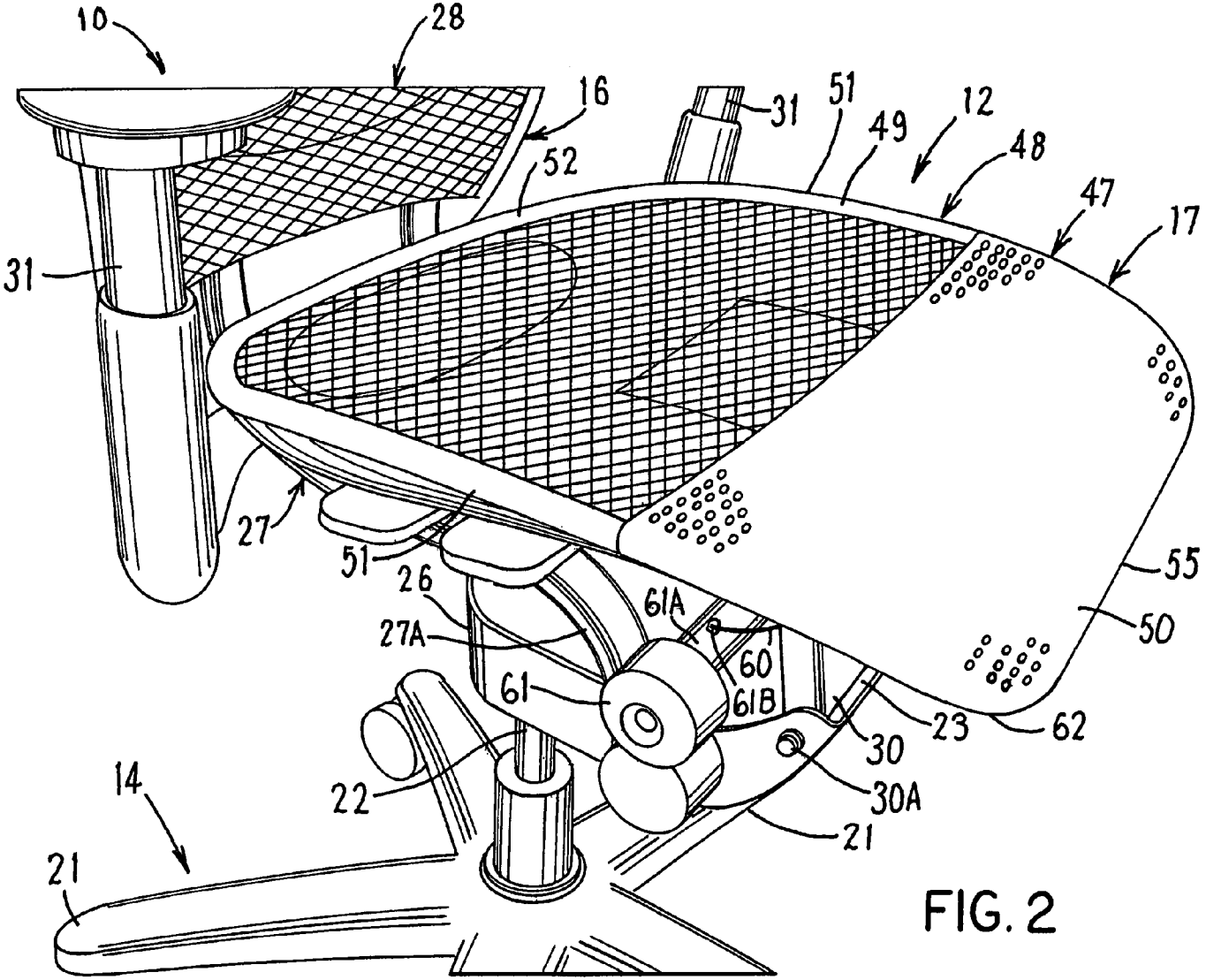
FIG. 2 is an enlarged perspective view of the suspension seat assembly.

An adjustment handle 61 (FIGS. 1 and 4) is connected to the cable 60 to pull and in effect deflect the front panel 50 downwardly as seen in FIG. 5 to an adjusted position identified by reference line 53C. As seen in FIG. 2, the handle 61 has a rotatable shaft 61A and a connector flange 61B located on the shaft 61A. The cable 60 is connected to the flange 61B such that rotation of the shaft 61A pulls the cable 60 to pull the front panel 50 downwardly.

This adjusts the contact point from location 54-1 to location 54-2 of the front panel 50 with the occupant 46 and thereby adjusts the effective length of the seating area as measured in the front to back direction. Since the cable 60 is under tension, this arrangement permits the front panel 50 to deflect downwardly under the influence of the occupant's weight or movement but limits or restricts upward movement of the front panel 50.

The front panel 50 is able to resiliently deflect downwardly away from the adjusted position 53C in substantially the same manner as the movement of the panel 50 when in the initial position 53A. The resiliency of the front panel 50 normally biases the front panel 50 upwardly toward the adjusted position 53C since the cable 60 only restricts movement in the upward direction but allows unrestrained downward movement. With this arrangement, a resiliently deflectable front panel 50 is provided with the advantages thereof being maintained while still allowing for adjustment of the contact point 54-1 or 54-2. It will be understood that the positions 53A, 53B and 53C as illustrated in FIG. 5 are representative positions and that adjustment of the front panel 50 away from the initial position 53A can be set to any downwardly deflected position located between positions 53A and 53C, as well as possibly further downwardly away from the position 53C. The actual adjusted position 53C set by the occupant will depend upon the preferences of the occupant and is usually dictated by the comfort provided by the location of the contact point 54-2 with the thighs 57.

If flexing of the front panel 50 is not desired in the downward direction, a rigid lever also may be provided which controls the deflection of the front panel 50 but limits or restricts downward flexing thereof.

The front panel 50 also is perforated with apertures 62 to facilitate air flow to the occupant's legs and perform a function similar to the air-permeable or open-weave suspension fabric 49.

Figure 12:
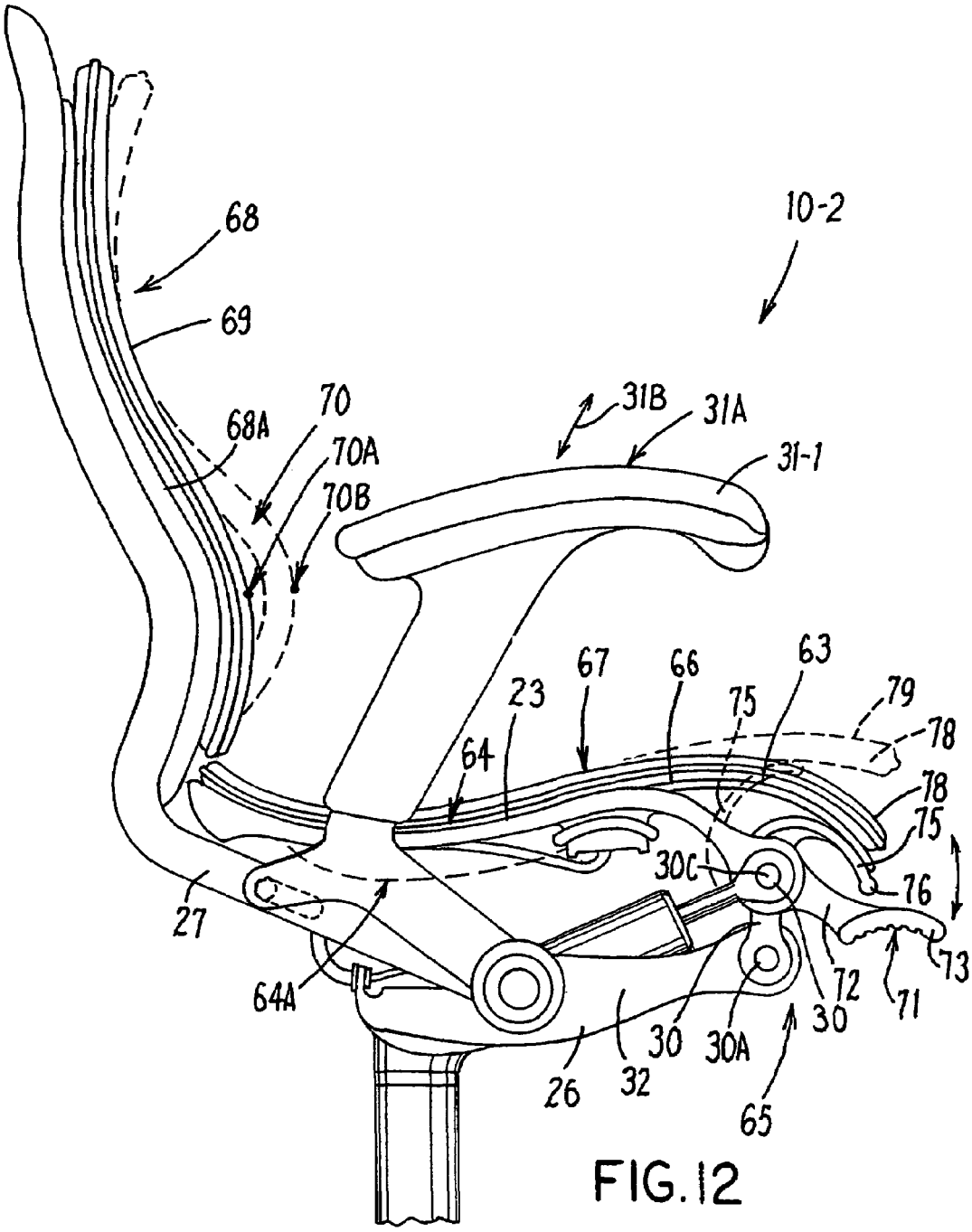
FIG. 12 is a side elevational view of a chair having a second adjustment mechanism for the front seat edge.

FIG. 12 illustrates a further embodiment of a chair 10-2 which includes a second type of adjustment mechanism 65 for controlling the deflection of a front section or panel 66 of the seat 67. The seat 67 and the front seat section 66 thereof are substantially the same as the seat 17 and front panel 50 described above although a thin seat pad 63 is provided on top of the underlying mesh 64. The pad 63 and mesh 64 stretch downwardly to the position indicated by arrow 64A under the weight of an occupant.

The chair 10-2 generally includes additional features including shoulder support adjustment in the back 68 as illustrated in phantom outline at the top of the back 68, a thin back pad 69 wherein mesh 68A overlies the back and seat, and an adjustable lumbar mechanism 70 with the minimum and maximum lumber positions identified therefor by reference numerals 70A and 70B. The armrest 31-1 has a mesh cap 31A and is vertically adjustable as indicated by reference arrow 31B.

Notably, the chair 10-2 includes a four-bar linkage arrangement which is substantially the same as that identified in FIG.

3, and thus, common reference numerals are used herein to identify the rigid arm 26, the back upright 27, the seat frame 23, and the front link 30. The front link 30 is connected at its lower end 30A to the rigid arm 26, and at its upper end 30B to the seat frame 23. The upper end 30B of the link 30 defines a pivot connection 30C about which the seat frame 23 and front link 30 are pivotally joined together. Further, the pivot connection 30C provides pivotal support to the adjustment mechanism 65 as discussed herein.

The adjustment mechanism 65 includes a front edge adjustment handle 71 which has a main arm 72 that is pivotally connected to and supported on the pivot connection 30C. The adjustment handle 71 further includes a manually grippable hand piece 73 which projects radially outwardly and may be operated by the chair occupant to pivot the adjustment handle 71 about a horizontal axis defined by the pivot connection 30C. The adjustment handle 71 is located along the right side edge of the chair and is accessible by the occupant who may reach down along the side of the chair to grip the adjustment handle 71.

The adjustment mechanism 65 further includes an arcuate adjustment lever 75 formed of a resilient material such as a plastic. The lever 75 has an inner end pivotally supported on the pivot connection 30C inwardly of the adjustment handle 71. The lever 75 curves forwardly and downwardly as seen in solid outline in FIG. 12 and has a free end 76, the upper surface of which slidably contacts the bottom surface of the front seat shell section 66 and functions as a cam to move the shell section 66 during rotation of the lever 75. Preferably, the seat shell section 66 is molded with a downward curvature so as to naturally take the shape of the minimum front edge position or undeflected position 78 seen in FIG. 12. The front section 66, however, is resiliently deflectable upwardly to the maximum front edge position 79 in response to rotary movement of the adjustment lever 75.

More particularly, the lever 75 is sufficiently rigid so that rotation of the handle 71 rotates the lever 75 in the counterclockwise or rearward direction presses and causes an upward deflection of the shell section 66 to the position 79 illustrated in phantom outline. This thereby changes the curvature of the shell section 66 to adjust the contact location of the thighs of an occupant with the radius of curvature of the shell section 66.

While the lever 75 provides upwardly-directed vertical support to the shell section 66 to change the curvature thereof, the lever 75 also is formed of a resilient elastomeric material which biases the shell section 66 upwardly but is deflectable downwardly to permit the seat section 66 to deflect in response to user movements or the weight of the user.

For adjustment of the position of the seat section 66 between the minimum position 78 and the maximum position 79, the handle 71 and the lever 75 are rigidly connected together along the axis of the pivot connection 30C such that rotation of the handle 71 causes a corresponding rotation of the lever 75. With this arrangement, the seat section 66 is normally held in an adjusted position but is still deflectable downwardly.

FIGS. 13-18 illustrate further adjustment mechanisms for adjusting the contact position between the front edge of the seat and the thighs of the chair occupant.

Figure 13:
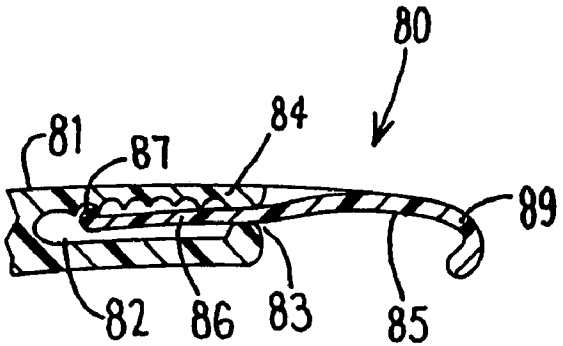
FIG. 13 illustrates a third adjustment mechanism.

FIG. 13 illustrates a seat frame 81 which has a channel 82 formed therein that opens from a front end 83 and includes serrated ridges 84 within the interior of the chamber 82. The seat further includes a flexible front section 85 that has a rear end 86 which is slidably received within the interior chamber 82. The rearmost edge of the rear section 86 includes an upward projecting bead 87 which snaps into a selected one of the serrations 84. The front section 85 can be pulled out of the chamber 82 wherein the resiliency of the rear section 86 allows the bead 87 to deflect downwardly and ride over the ridges between each serration. The front portion 89 of the seat section 85 projects outwardly in cantilevered relation from the seat frame 81 and is formed of a soft flexible plastic so as to deflect downwardly in response to the weight of the user.

Figure 14:
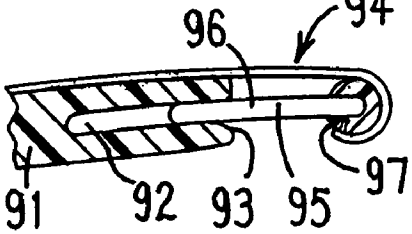
FIG. 14 illustrates a fourth adjustment mechanism.

FIG. 14 illustrates a fourth adjustment mechanism 90 which includes a seat frame 91 having an interior chamber 92 formed therein that opens outwardly through an open front end 93. The seat frame 91 includes a mesh 94 which overlies the seat frame 91 and projects outwardly to a mesh support mechanism 95. The mesh support mechanism 95 includes a support arm 96 which is slidably received within the interior chamber 92 through the open front end 93 thereof. The mechanism 95 also includes a spring loaded roller 97 which is connected to the arm 96 and operates similar to a window shade roller in that the roller 97 includes a spring urged tendency to wind itself back up. The mesh 94 is connected to the roller 97 such that outward sliding of the arm 96 allows the roller 97 to unwind and allow the mesh portion 94 to extend an increased distance beyond the seat frame 91. When the arm 96 is moved back into the chamber 92, the roller 97 winds itself up to wind the mesh 94 thereon.

Figure 15:
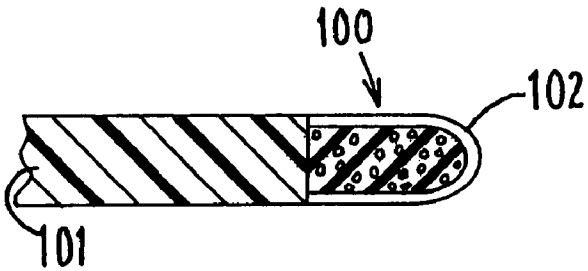
FIG. 15 illustrates a fifth adjustment mechanism.
Figure 20:
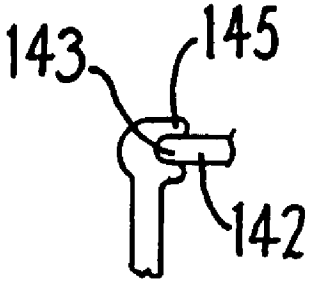
FIG. 20 is a partial front elevational view of the seventh adjustment mechanism.

FIG. 15 illustrates a fourth mechanism 100 which includes a seat frame 101 having a front lip section 102 thereon. The front lip section 102 is formed of foam and is flexible and includes a pneumatic purge valve to control the expansion and the relative flexibility of the foam section 102.

Figure 16:
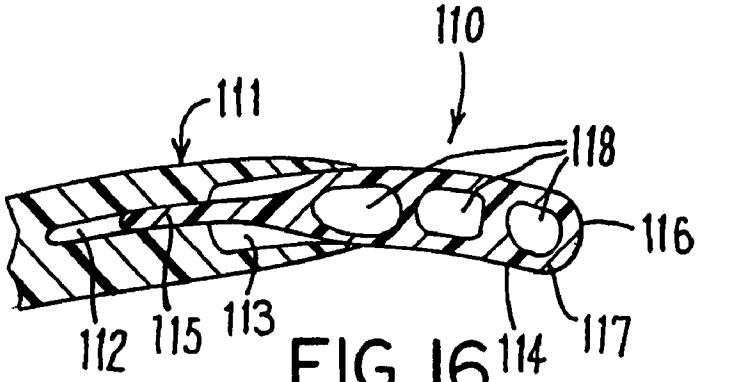
FIG. 16 illustrates a sixth adjustment mechanism.

FIG. 16 illustrates a sixth adjustment mechanism having a seat frame 111 which includes a thin interior chamber section 112 and a large interior chamber section 113 in communication therewith.

The adjustment mechanism 110 further includes a front edge insert 114 which is inserted into the chambers 112 and 113. More particularly, the front edge insert 114 includes a guide flange 115 that is slidably received within the thin chamber 112. Further, the front edge insert 114 includes the seat portion 116 which has a rear section thereof received in the large chamber 113, and a front end section 117 which projects outwardly from the seat frame 111. The front edge section 116 includes air chambers 118 formed therein to allow for deflection and resiliency. The front edge insert 114 is slid into and out of the chambers 112 and 113 to adjust the length or depth of the overall seat. If desired, the front edge insert 114 may be provided in combination with other inserts having various front to rear lengths wherein the various inserts are interchangeably inserted into the chambers 112 and 113. Each different sized insert 114 thereby provides a different range of front to rear adjustment.

Figure 17:
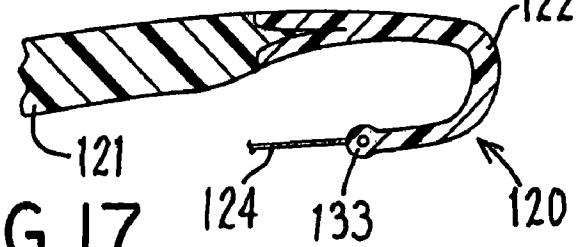
FIG. 17 illustrates a seventh adjustment mechanism.

FIG. 17 illustrates a seventh adjustment mechanism 120 having a seat frame 121 to which is connected a generally U-shaped front edge section 122. The front edge section 122 curls under and rearwardly and terminates at a cable connector 123. The connector 123 is connected to a cable 124 wherein pulling of the cable 124 rearwardly causes the elastomeric front edge section 122 to be retracted rearwardly to shorten the length of the seat. The elasticity of the front edge section 122 returns the seat to its normal position once the cable 124 is released.

Figure 18:
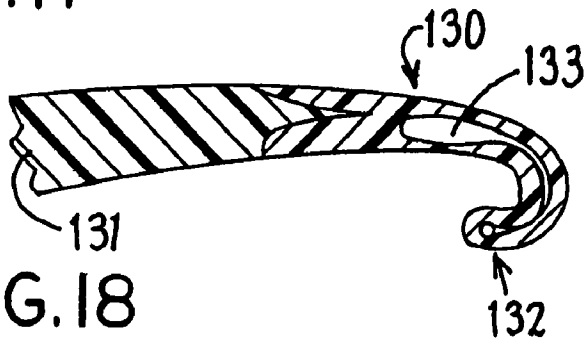
FIG. 18 illustrates an eighth adjustment mechanism.

FIG. 18 illustrates an eighth adjustment mechanism 130 having a seat frame 131 to which is connected a front seat section 132. The front seat section 132 curls downwardly and rearwardly and includes an interior chamber 133 therein. The air chamber 133 serves as an expansion chamber wherein an air source is connected to the air chamber 133 to cause air to be pumped therein. The front edge section 132 is formed of a flexible elastomer such that pumping of the air into the air chamber 133 causes the front edge section 132 to operate similar to a "party blower" wherein increased air pressure in the air chamber 133 causes the front edge section 132 to straighten out in the forward direction and cause an extension of the seat position.

Figure 19:
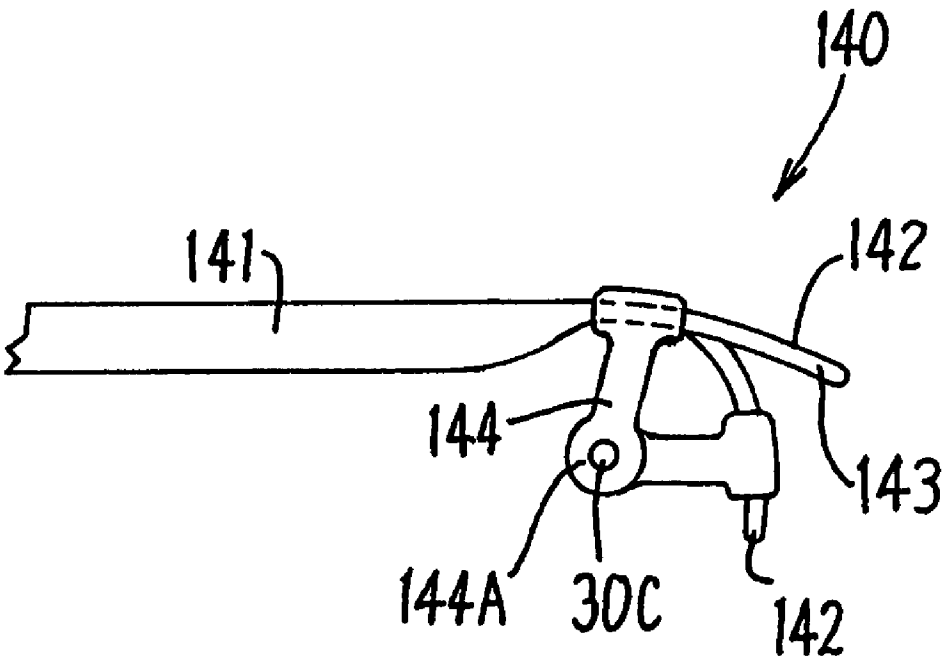
FIG. 19 is a side view of a seventh adjustment mechanism.

FIG. 19 illustrates a ninth adjustment mechanism 140 which is connected to a flexible seat shell 141 formed similar to the seat shell described above. The flexible seat shell 141 includes a deflectable front lip 142 like the front panel 50 which is defined laterally by opposite side edges 143.

An adjustment lever 144 is provided which pivots about the pivot connection 30C similar to the lever 75 discussed above. This adjustment lever 144 includes a manually rotatable handle 144A at the outer end thereof and a slot 145 that opens inwardly and confines the side edge 143 of the seat section 142. A second lever 144 is provided on the opposite side edge 143 of the front seat section 142. The adjustment handle 144A is formed substantially the same as the handle 71 is connected to the adjustment arms 144 on the opposite side edges of the seat section 142 wherein rotation of the handle 144A causes both the adjustment levers 144 to rotate forwardly and downwardly. The slots 143 formed in the levers 144 slide along the side edges of the seat section 142 and thereby pull the front seat section 143 downwardly as seen in FIG. 19. This adjusts the overall extension of the front seat section 142 to adjust the contact position with the thighs of the occupant.

Figure 21:
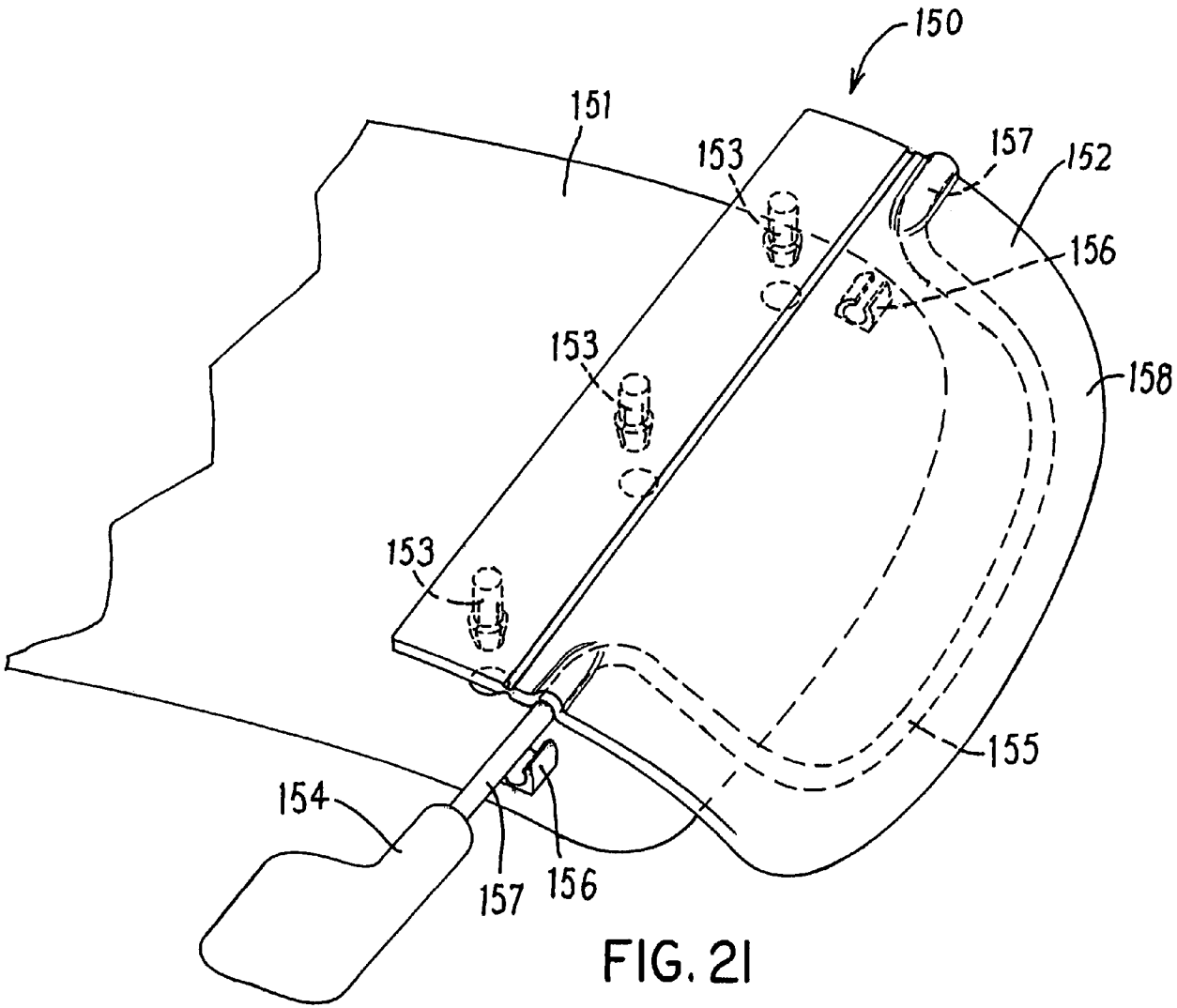
FIG. 21 is a perspective view of an eighth adjustment mechanism.
Figure 22:
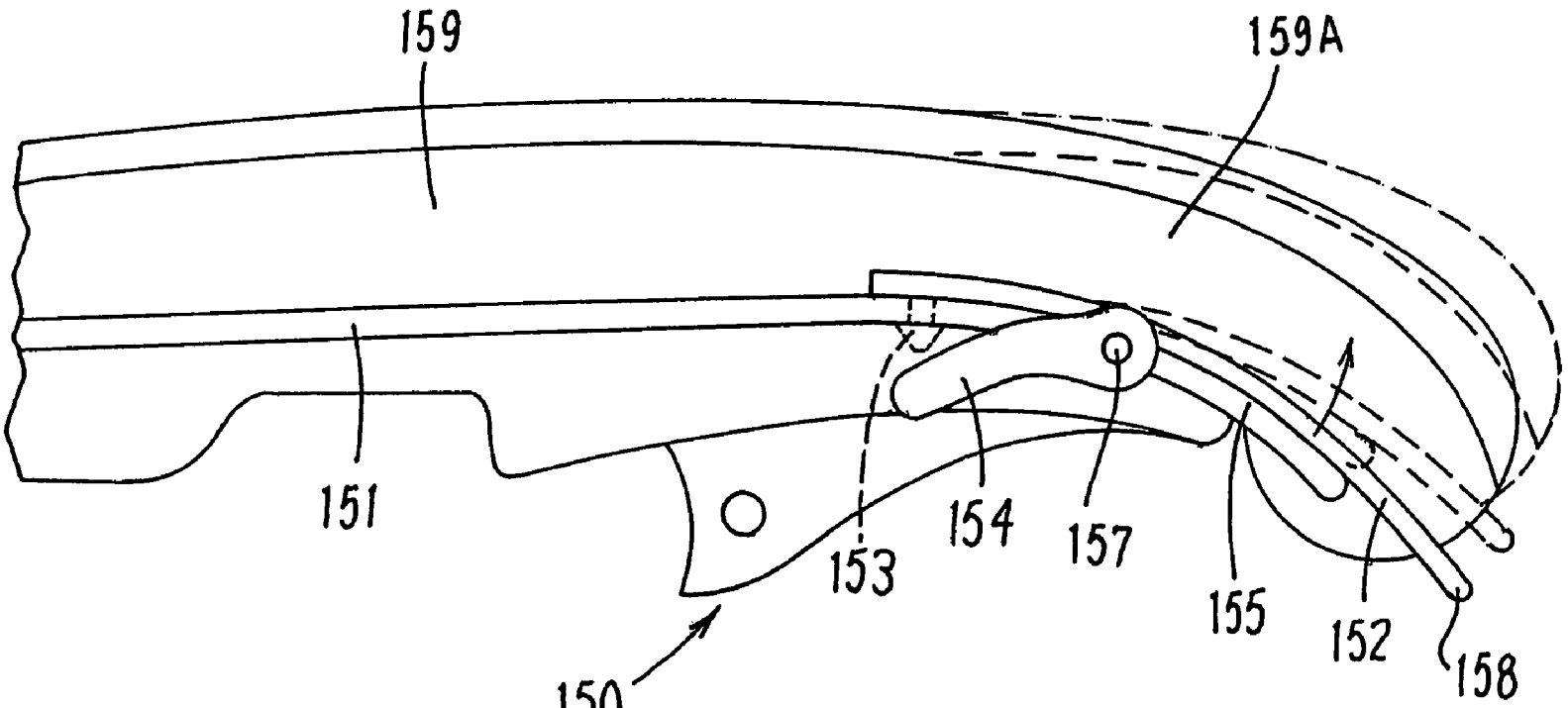
FIG. 22 is a side elevational view of the eighth adjustment mechanism.

FIGS. 21 and 22 illustrate a tenth adjustment mechanism 150 which is a variation of the mechanisms of FIGS. 12 and 19 which use levers. More particularly, the mechanism 150 includes an existing seat section 151 and an add-on front seat section 152. The add-on front section 152 is connected to the existing inner shell 151 by push in retainers 153. Additionally, a lever handle 154 is provided which is connected to a bent-rod lever 155. The bent-rod lever 155 is pivotally connected to the inner shell 151 by snap connectors 156.

The lever 155 includes coaxially aligned straight sections 157 which snap into the retainers 156 and allow for pivoting movement of the lever 155. The lever 155 acts on the bottom surface of the flexible seat section 152 to adjust the elevation of the front lip 158. As seen in FIG. 22, a cushion 159 may be provided having elastic membrane 159A over the top thereof.

Figure 23:
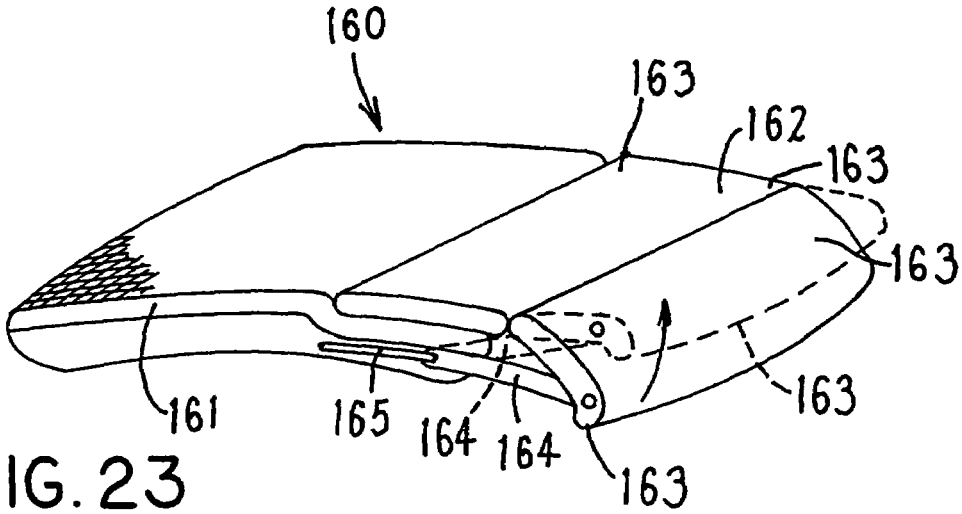
FIG. 23 is a perspective view of a ninth adjustment mechanism.

Referring to FIG. 23, an eleventh adjustment mechanism 160 is illustrated connected to a stationary back seat section 161. The adjustment mechanism 160 includes a front seat section 162 that extends forwardly from the back seat section 161 and is formed by articulating segments 163 which are pivotally connected together similar to a roll top desk. The terminal or frontmost segment 163 is connected to a pivoting lever 164 that itself is connected to an actuator handle 165 to effect rotating movement of the lever 164. When the lever 164 is in the lower position, the front segment 163 is articulated downwardly to a lower position. When the lever 164 is rotated upwardly as seen in FIG. 23 in phantom outline, the front segment 163 is articulated upwardly.

Figure 24:
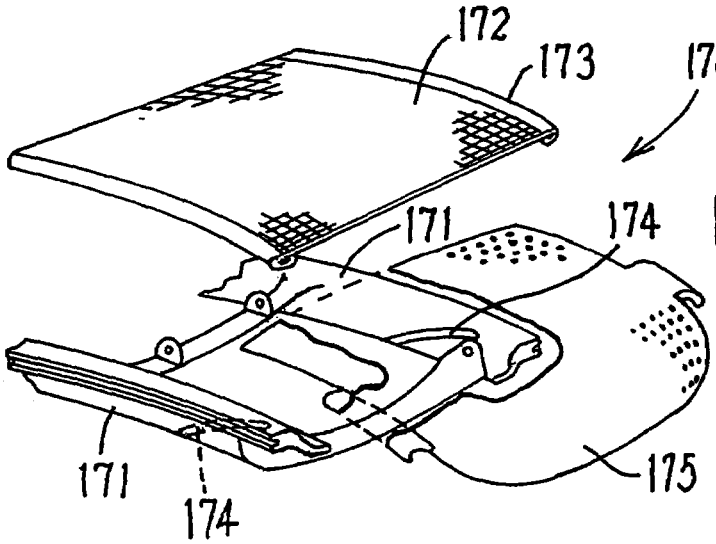
FIG. 24 is an exploded perspective view of a tenth adjustment mechanism.
Figure 25:
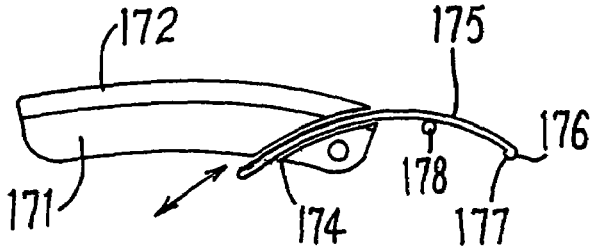
FIG. 25 is a side elevational view of the tenth adjustment mechanism.

FIG. 24 illustrates a twelfth adjustment mechanism 170 which cooperates with a seat frame 171 and an overlying suspension fabric or mesh 172. The suspension fabric 172 is supported in a molded frame 173 and itself is connected to the frame 171. The frame defines an interior guideway 174 in which a front seat section 175 is slidably fitted. The front seat section 175 has a front edge 176 wherein sliding of the front seat section 175 into and out of the track or guideway 174 causes the front edge 176 to move from the forwardly extended position 177 to a retracted position 178. This again allows for adjustment of the position of the front seat section.

Figure 26:
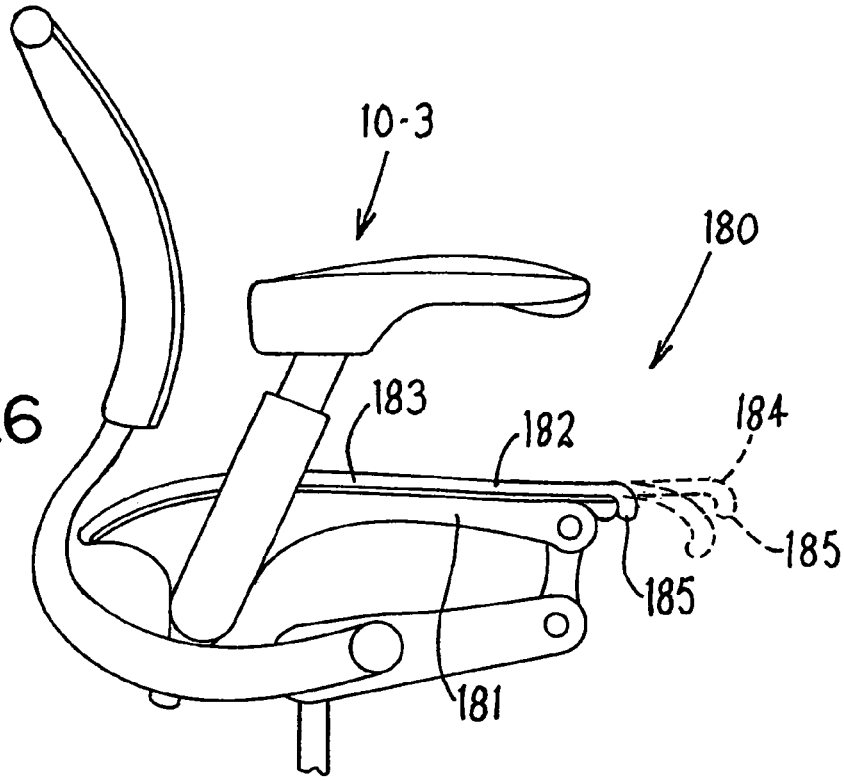
FIG. 26 is a side view of a chair with an eleventh adjustment mechanism.
Figure 27:
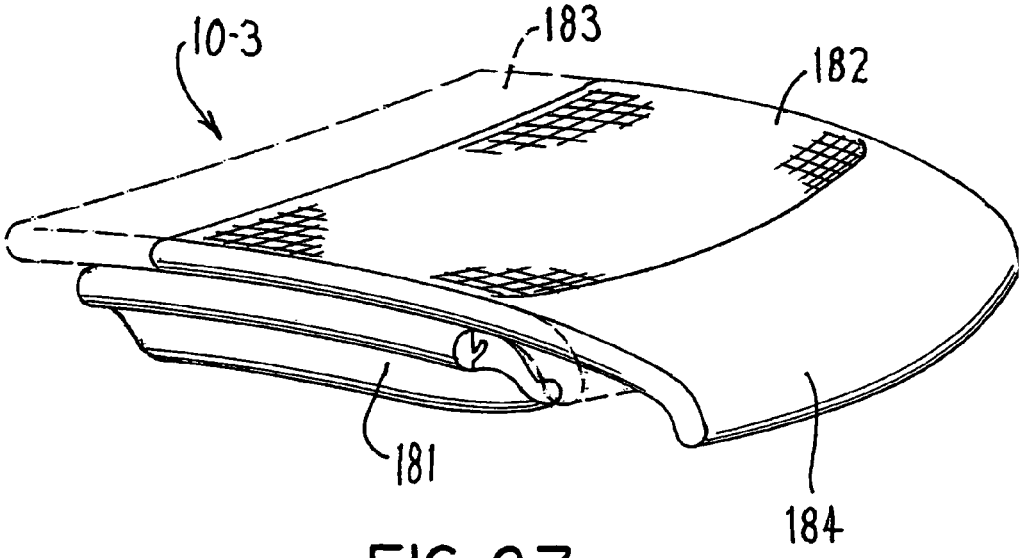
FIG. 27 is a perspective view of the chair of FIG. 26.

FIGS. 26 and 27 illustrate a thirteenth adjustment mechanism arrangement 180 for a chair 10-3. The adjustment mechanism 180 includes a frame 181 on which a cushion 182 is slidably connected. When slidably connected, the seat 182 may be moved from a rearmost position 183 as seen in FIGS. 26 and 27 to an extended position 184 as seen in phantom outline in FIG. 26 in solid outline in FIG. 27. The front edge 185 of the seat 182 is resiliently deflectable so that when it is fully extended, the front edge 185 is deflectable downwardly as illustrated in phantom outline in FIG. 26. When retracted, the front edge 185 is supported by the frame 181 to limit downward deflection thereof.

Referring to FIG. 28-31, a further embodiment of a chair is illustrated therein as designated by reference numeral 190. The chair 190 includes components thereof which are substantially identical to those of the chair of FIG. 1-2 and common components are identified by the same reference numerals.

In particular, the chair 190 includes a base 14 having a post 22 and a support arm or housing 26. A four-bar linkage is defined by an upright 27, a front link 30 and a structural seat frame 23-1 which forms part of the seat assembly 17-1.

Figure 28:
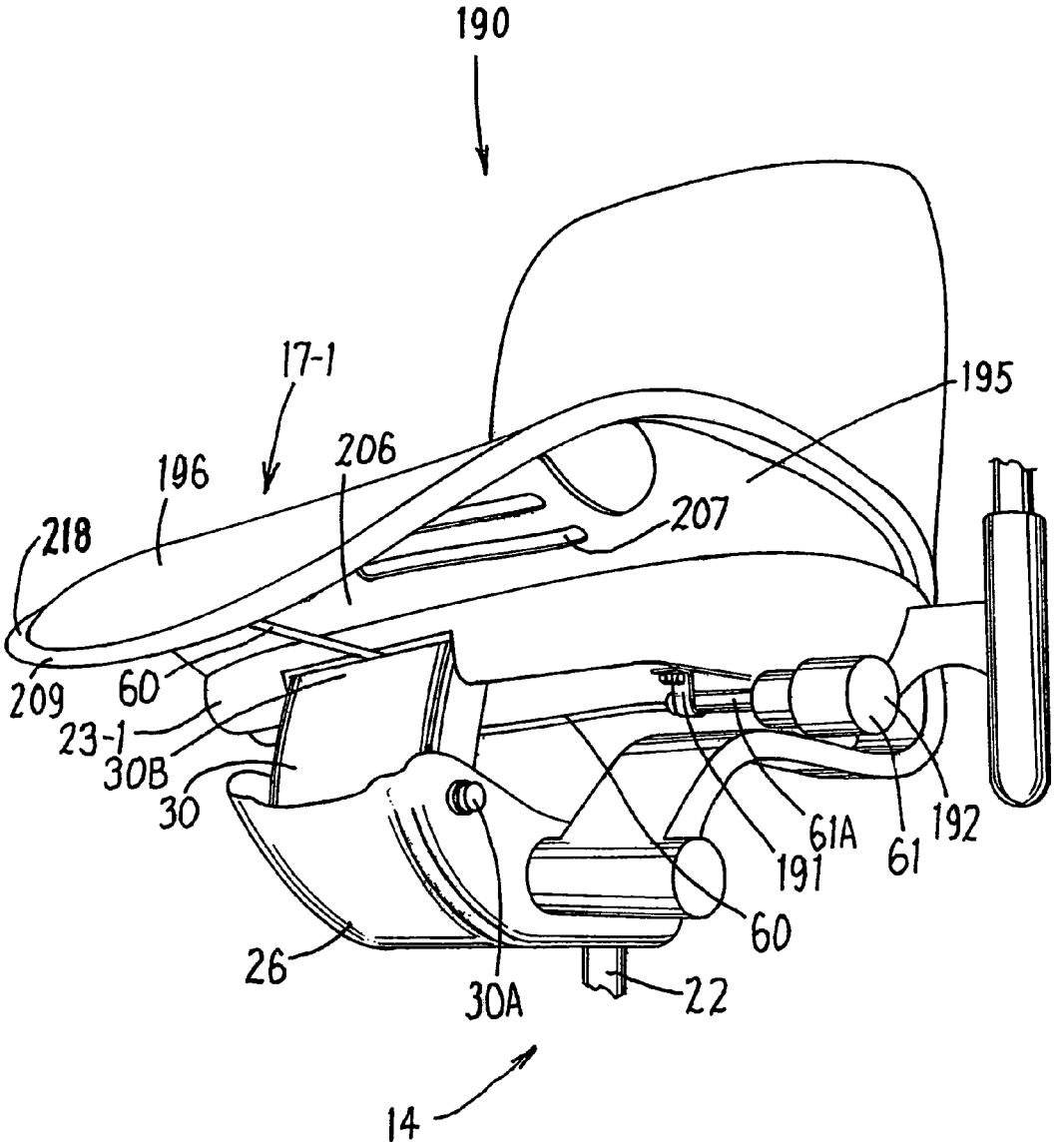
FIG. 28 is a perspective view of a further embodiment of a chair.

The chair 190 further includes an adjustment handle 61 which is fixedly mounted to the support frame 23-1 by a mounting bracket 191. The adjustment handle 61 is formed substantially the same as that of FIG. 1 except that it is mounted to the opposite side of the chair in FIG. 28. The handle 61 includes a manually-rotatable knob 192 which is connected to the shaft 61A. A cable 60 is connected between the adjustment handle 61 and the front edge of the seat assembly 17-1 as described in further detail herein. The cable 60 extends between a gap defined between the upper end 30B of the front link 30 and an adjacent edge of the support frame 23-1 as seen in FIG. 28. Rotation of the handle 61 as indicated by reference arrow 193 causes a corresponding linear movement of the cable 60 as indicated by reference arrow 194.

The primary distinction between the chair 190 and the chair 10 of FIG. 1 is in the construction of the seat assembly 17-1. In the seat assembly 17-1, a molded seat shell 195 is provided in combination with a cover pad 196 as separate components rather than being molded together as in the seat assembly 17 of FIG. 1.

More particularly as to the seat assembly 17-1, the support frame 23-1 is formed of a rigid material and has a front window 197 through which the front link 30 is received. The opposite sides of the window 197 include pivot mounts 198 to which the upper end 30B of the front link 30 is pivotally connected. The rear wall 199 of the support frame 23-1 also includes further pivot mounts 200 to which the separate arms of the upright 27 are pivotally connected in a four-bar linkage arrangement.

The shell 195 includes a bottom wall 201 formed with mounting holes 202 by which the support shell 195 is fastened to the support frame 23-1. The shell 195 includes an upper rim 205 and a flexible front panel 206 which functions similar to the front panel 50 described above. The front panel 206 is formed with two rows of parallel slots 207 which facilitate downward flexing of the front edge 209 of the shell 195.

Figure 29:
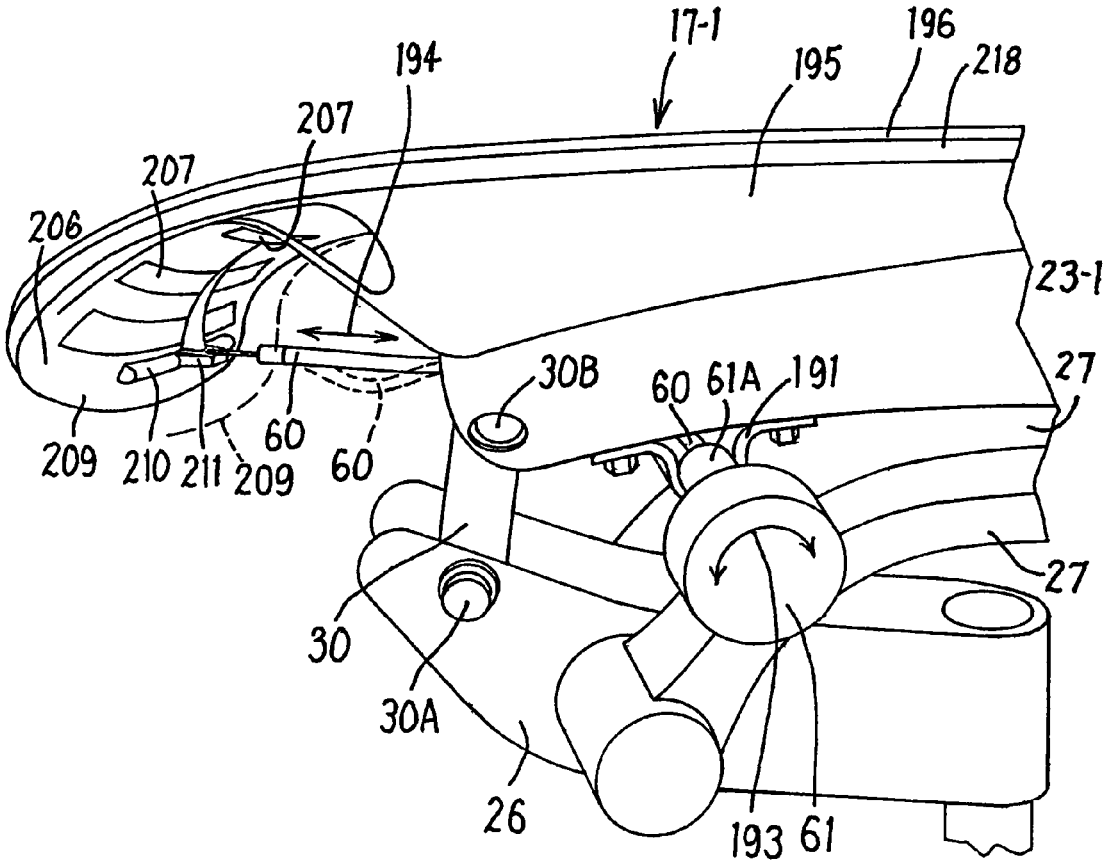
FIG. 29 is a side perspective view of the chair.
Figure 30:
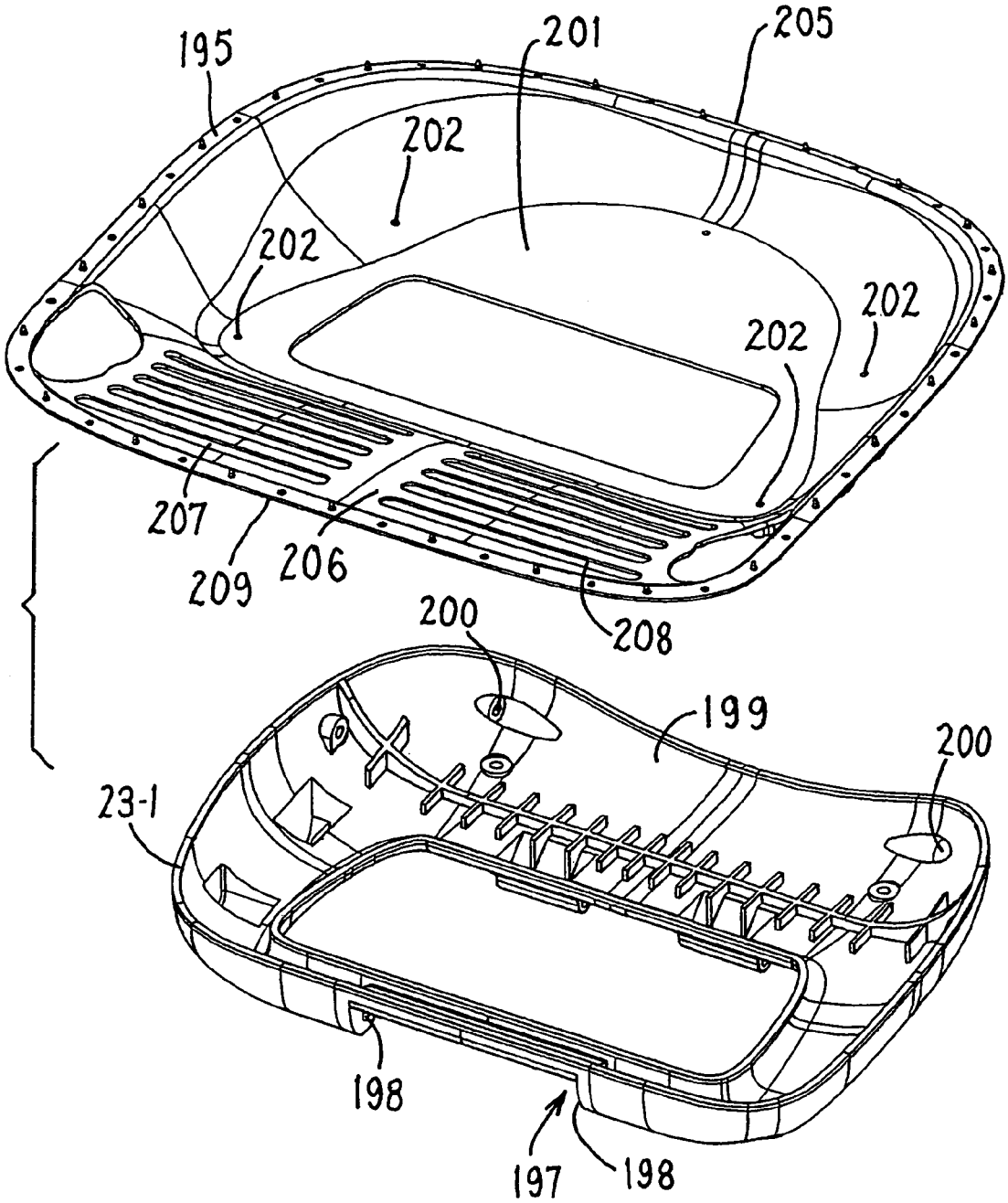
FIG. 30 is a perspective view of the support frame and molded shell for the chair of FIGS. 28 and 29.

The bottom surface of the front panel 206 is formed with a horizontally elongate mounting rib 210 as seen in FIG. 29. The adjustment cable 60 includes a mounting clip or bracket 211 on the front end thereof which is affixed to the mounting rib 210 to join the cable 60 and the front shell section 206 together. As such, pulling of the cable 60 in the direction of arrow 195 causes a corresponding flexing movement of the front edge 209. As indicated in phantom outline in FIG. 29, flexing of the front panel 206 causes a downward movement of the front shell edge as indicated in phantom outline since the cable 60 is flexible and is able to bow as also indicated in phantom outline in FIG. 29.

Figure 31:
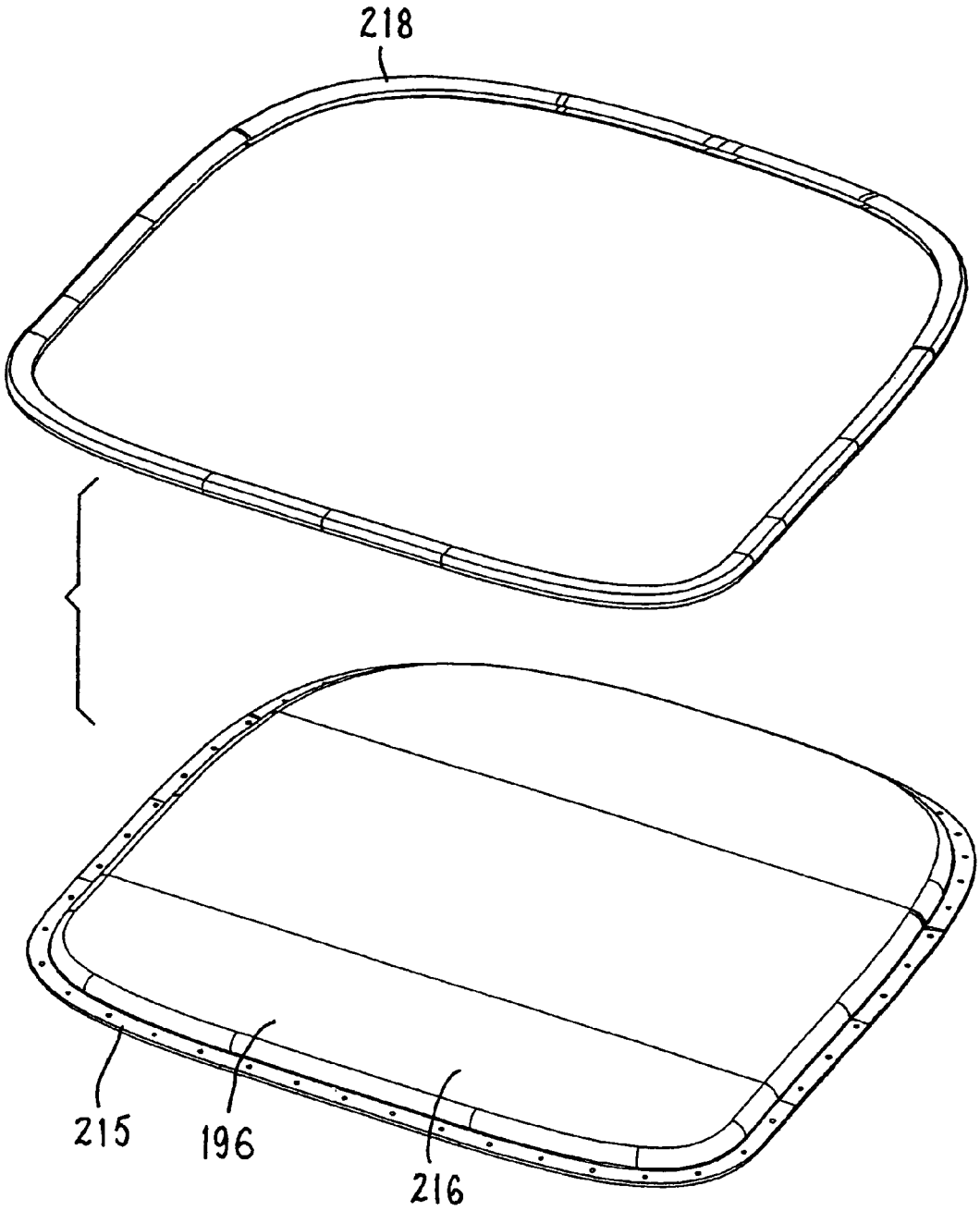
FIG. 31 is a perspective view of the seat pad and trim ring which are supported on the seat shell of FIG. 30.

Referring to FIG. 31, the cover pad 196 includes a peripheral edge 215 which is fixed in place on the corresponding rim 205 of the seat shell 195 so as to be suspended therefrom. The pad 196 forms the cushion for the seat and the front portion 216 thereof is adapted to flex downwardly in unison with the front shell section 206. Additionally, a peripheral trim piece 218 is either fixed onto or molded in place on the. edge of the pad 196 and the shell 195.

Therefore, in this arrangement, the cable 60 is connected directly to an underlying support shell wherein a separate suspension cushion 196 is suspended thereon.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A chair comprising:

a base having a support post;

a seat supported on said support post of said base which said seat defines a support surface for supporting the seat and thighs of an occupant, said seat comprising a rear seat section supported on said base and a flexible front seat section which extends forwardly from said rear seat section, said front seat section being resiliently flexible in a vertical direction so as to generate a resilient restoring force which resists deflection of said front seat section away from an initial position while permitting downward deflection of said front seat section away from said initial position to a user response position, said support surface having a contour defined by said front and rear seat sections which varies by the deflection of said front seat section relative to said rear seat section between said initial position and said user response position;

said seat comprising a seat shell and a thin, flexible cover member connected about its periphery to said seat shell to define an upward facing seat surface for supporting the chair occupant, said seat shell including a bottom section connected to said support post and a support rim which fixedly supports said periphery of said cover member and is spaced above said bottom section to define an open area below said cover member to accommodate downward flexing thereof under load, said seat shell including a front panel disposed below said cover member and projecting forwardly in a forward direction and upwardly to define a front rim section of said support rim, said front panel being formed as one piece of a shell material and having flex facilitating formations defined in said shell material which facilitate downward flexing of said front panel under load wherein said front panel and a front portion of said cover member defines said front seat section that is deflectable downwardly between said initial position and said user response position, said flex facilitating formations comprising a pattern of slots formed in said shell material of said front panel which said slots are sidewardly elongate and forwardly spaced one from another in said forward direction to facilitate downward flexing of said front panel over a forwardly extending extent thereof, said shell material, when flexed, serving to resiliently restore said front panel from said user response position to said initial position.

2. The chair according to claim 1, which includes an adjustment mechanism having a manual actuator and a connector member which is connected to said front panel of said front seat section and is movable by manual operation of said actuator to adjust the deflection of said front seat section relative to said rear seat section.

3. The chair according to claim 2, wherein said actuator is manually moveable to effect movement of said connector member to move said front seat section from said initial position to an adjusted position and maintain said front seat section in said adjusted position while permitting downward movement of said front seat section from said adjusted position to said user response position.

4. The chair according to claim 3, wherein said front panel is resiliently deflectable to define a restoring force which biases said front seat section away from said user response position back to said adjusted position.

5. The chair according to claim 4, wherein said slots open vertically through said front panel to facilitate bending of said front panel downwardly under load.

6. The chair according to claim 3, wherein said connector member is flexible in a downward direction to permit said movement of said front seat section to said user response position either from said adjusted position or from said initial position.

7. The chair according to claim 6, wherein said connector member is a cable which pulls said front seat section downwardly in tension.

8. The chair according to claim 1, wherein said slots open vertically through said front panel to facilitate bending of said front panel downwardly under load.

9. The chair according to claim 1, wherein said front seat section is disposed in cantilevered relation relative to said bottom shell section and said base and is formed of a resiliently flexible elastomeric material.

10. The chair according to claim 1, wherein said cover member includes a cushion overlying said seat shell.

11. A chair comprising:

a base having a support frame;

a seat supported on said support frame, said seat comprising a horizontally enlarged chair shell having a connector section and a support rim disposed above said connector section, said seat further comprising a flexible cover member suspended from said chair shell in a raised position such that an open area is defined below said cover member, said cover member having contiguous front and rear support sections that define an upward facing support surface which supports the seat and thighs of a chair occupant and has a contour defined by said front and rear support sections, said seat defining an effective seat length of said support surface which extends from a rear portion of the occupant's seat to a contact location on said front portion of said cover member wherein said support surface separates from the thighs of an occupant, said chair shell having said connector section disposed over said support frame and affixed thereto and a front shell section which extends forwardly from said connector section so as to extend forwardly of said support frame in cantilevered relation therewith to support said front support section of said cover member, said front shell section including a pattern of slots therein which facilitate deflection of said front shell section downwardly; and an adjustment mechanism having a manually actuatable connector member engaged with said front shell section forwardly of said support frame wherein said connector member maintains said front shell section in a first position and manual movement of said handle deflects said front shell section vertically relative to said rear shell section away from said first position to an adjusted second position which varies the contour of the support surface to adjust the contact location between said support shell and the thighs of the occupant and adjust the effective seat length, said connector member being moveable in a downward direction in response to the weight and/or movements of an occupant to permit deflection of said front shell section away from said adjusted second position to a user-responsive third position.

12. The chair according to claim 11, wherein said front shell section is resiliently deflectable, and the resiliency of said front shell section generates a restoring force in a first vertical direction and said adjustment mechanism generates an adjustment force through said connector member which acts in a second direction opposite to said first direction to deflect said front shell section.

13. The chair according to claim 12, wherein said front shell section is hidden from above by said cover member.

14. The chair according to claim 11, wherein said adjustment mechanism generates said adjustment force in a downward direction and the resiliency of said front shell section generates said restoring force in an upward direction.

15. A chair comprising:

a base;

a horizontally enlarged seat comprising a seat shell having a rear shell section supported on said base and a front shell section extending forwardly of said base from said rear shell section, said front shell section being formed of a resiliently deflectable material, said seat shell defining a support rim and said seat further comprising a suspension member suspended about its periphery from said support rim to define an upward facing support surface that overlies and covers said seat shell, said front shell section including flex facilitating formations formed as slots which facilitate bending of said front shell section downwardly along with a front portion of said suspension member suspended therefrom; and an adjustment mechanism having a manual actuator and a connector member which is connected to said front shell section forwardly of said rear shell section and is displaceable upwardly and downwardly relative to said rear shell section by movement of said actuator to deflect said front shell section relative to said rear shell section to an adjusted position, said connector member permitting downward deflection of said front shell section away from said adjusted position in response to downwardly directed forces applied thereto while maintaining said front shell section in said adjusted position in the absence of said downwardly directed forces.

16. The chair according to claim 15, wherein said seat shell generates a restoring force which biases said front shell section back to said adjusted position in the absence of said downwardly directed forces.

17. The chair according to claim 16, wherein said connector member permits said downward deflection of said front shell section away from said adjusted position without manual activation of said actuator.

18. A chair comprising:

a base having a support post;

a seat supported on said support post of said base which said seat defines a support surface for supporting the seat and thighs of an occupant, said seat comprising a rear seat section supported on said base and a flexible front seat section which extends forwardly from said rear seat section, said front seat section being resiliently flexible in a vertical direction so as to generate a resilient restoring force which resists deflection of said front seat section away from an initial position while permitting downward deflection of said front seat section away from said initial position to a user response position, said support surface having a contour defined by said front and rear seat sections which varies by the deflection of said front seat section relative to said rear seat section between said initial position and said user response position;

said seat comprising a seat shell and a thin, flexible cover member having a central cover section and a periphery bounding said central cover section, said cover member being connected about said periphery to said seat shell to suspend said cover member from said seat shell and define an upward facing seat surface for supporting the chair occupant, said seat shell including a bottom section connected to said support post and a support rim which fixedly supports said periphery of said cover member and is spaced above said bottom section to define an open area below said central cover section of said cover member to accommodate downward flexing of said central cover section interiorly of said periphery under load, said seat shell including a front panel disposed below a front portion of said central cover section of said cover member and projecting forwardly and upwardly to define a front rim section of said support rim which supports a corresponding front peripheral portion of said periphery with a front portion of said central cover section adjacent thereto being spaced vertically above an interior portion of said front panel, said interior portion of said front panel having flex facilitating formations which facilitate downward flexing of said front panel under load wherein said front panel and said front portion of said cover member defines said front seat section that is deflectable downwardly between said initial position and said user response position.

19. A chair comprising:

a base having a support post;

a seat supported on said support post of said base which said seat defines a support surface for supporting the seat and thighs of an occupant, said seat comprising a rear seat section supported on said base and a flexible front seat section which extends forwardly from said rear seat section, said front seat section being resiliently flexible in a vertical direction so as to generate a resilient restoring force which resists deflection of said front seat section away from an initial position while permitting downward deflection of said front seat section away from said initial position to a user response position, said support surface having a contour defined by said front and rear seat sections which varies by the deflection of said front seat section relative to said rear seat section between said initial position and said user response position;

said seat comprising a molded seat shell and a thin, flexible cover member connected about its periphery to said seat shell to define an upward facing seat surface for supporting the chair occupant, said seat shell including a bottom section connected to said support post and an annular support rim, which said support rim fixedly supports said periphery of said cover member and is spaced above said bottom section to define an open area below said cover member, said cover member having a central cover section bounded by said periphery which spans said open area in suspension wherein said open area accommodates downward flexing of said central cover section under load, said seat shell including a molded front panel disposed below said cover member and projecting forwardly and upwardly to define a front rim section of said support rim, said front rim section being connected to said periphery wherein a front portion of said cover member is suspended above said front panel in vertically spaced relation, said front panel having flex facilitating formations molded therein which facilitate downward flexing deformation of said front panel under load wherein said front panel and a front portion of said cover member defines said front seat section that is deflectable downwardly between said initial position and said user response position.

20. The chair according to claim 19, wherein said front panel is resiliently deflectable to define a restoring force which biases said front seat section away from said user response position back to said adjusted position.

21. The chair according to claim 20, wherein said flex facilitating formations comprise a pattern of vertical openings formed in said front panel.

22. The chair according to claim 21, wherein said openings comprise slots which are sidewardly elongate and open vertically through said front panel to facilitate bending of said front panel downwardly under load.

* * * * *